US009540168B2

(12) United States Patent
Bublitz et al.

(10) Patent No.: US 9,540,168 B2
(45) Date of Patent: Jan. 10, 2017

(54) CONTAINER HAVING NON-LINEAR AND LINEAR TRACKS FOR SUPPORTING MOVABLE DUNNAGE

(71) Applicant: Bradford Company, Holland, MI (US)

(72) Inventors: Timothy A. Bublitz, Grand Haven, MI (US); Mark J. Feenstra, Grand Haven, MI (US); Allen L. Burns, Holland, MI (US)

(73) Assignee: Bradford Company, Holland, MI (US)

( * ) Notice: Subject to any disclaimer, the term of this patent is extended or adjusted under 35 U.S.C. 154(b) by 0 days.

(21) Appl. No.: 15/211,774

(22) Filed: Jul. 15, 2016

(65) Prior Publication Data

US 2016/0325925 A1 Nov. 10, 2016

Related U.S. Application Data

(63) Continuation of application No. 14/848,920, filed on Sep. 9, 2015, now Pat. No. 9,422,081, which is a (Continued)

(51) Int. Cl.
*B65D 88/54* (2006.01)
*B65D 19/02* (2006.01)
(Continued)

(52) U.S. Cl.
CPC ..... *B65D 88/546* (2013.01); *B65D 19/02* (2013.01); *B65D 85/68* (2013.01); *B65D 90/008* (2013.01); *B65D 90/02* (2013.01); *B65D 90/12* (2013.01); *B65D 2519/00034* (2013.01); *B65D 2519/0097* (2013.01); *B65D 2519/00164* (2013.01); *B65D 2519/00233* (2013.01); *B65D 2519/00805* (2013.01); *B65D 2585/6887* (2013.01)

(58) Field of Classification Search
CPC ..... B65D 88/546; B65D 90/02; B65D 85/68; B65D 19/02; B65D 90/008; B65D 90/12; B65D 2519/00164; B65D 2519/00233; B65D 2519/00034; B65D 2519/00805; B65D 2585/6887; B65D 2519/0097
USPC .... 220/544, 530, 535, 23.88, 534, 549, 500, 220/529; 206/544, 485, 425
See application file for complete search history.

(56) References Cited

U.S. PATENT DOCUMENTS 634,589 A 10/1899 Russell
1,712,168 A 5/1929 Rand, Jr.
(Continued)

FOREIGN PATENT DOCUMENTS

DE 19549166 3/1997
DE 20101374 4/2001
(Continued)

*Primary Examiner* — Robert J Hicks
*Assistant Examiner* — Kareen Thomas
(74) *Attorney, Agent, or Firm* — Wood, Herron & Evans, LLP

(57) ABSTRACT

A container for holding product therein during shipment and being returned for reuse has a frame, tracks supported by opposite sides of the frame, and a plurality of dunnage supports extending between the tracks. At least one of the tracks on each side is generally U-shaped and at least one is linear. Each dunnage support may comprise end members and a middle member, the end members being movable along the tracks. The dunnage supports support dunnage for supporting products for storage or shipment.

20 Claims, 30 Drawing Sheets

Related U.S. Application Data continuation-in-part of application No. 14/081,439, filed on Nov. 15, 2013, now Pat. No. 9,211,999.

(51) Int. Cl.

| | |
|---|---|
| ***B65D 85/68*** | (2006.01) |
| ***B65D 90/12*** | (2006.01) |
| ***B65D 90/02*** | (2006.01) |
| ***B65D 90/00*** | (2006.01) |

(56) References Cited

U.S. PATENT DOCUMENTS

| | | | | |
|---|---|---|---|---|
| 4,527,694 | A | 7/1985 | Bolt et al. | |
| 4,602,815 | A | 7/1986 | Boots et al. | |
| 4,685,571 | A | 8/1987 | Hoss | |
| 4,721,317 | A | 1/1988 | Avot | |
| 4,770,314 | A | 9/1988 | Giesler | |
| 4,821,879 | A | 4/1989 | Kupersmit | |
| 4,864,686 | A | 9/1989 | Lasier et al. | |
| 4,988,006 | A | 1/1991 | Lundin | |
| 5,238,139 | A | 8/1993 | Bisceglia | |
| 5,324,105 | A | 6/1994 | Christensen | |
| 5,407,262 | A | 4/1995 | Christian et al. | |
| 5,560,507 | A | 10/1996 | Arpin et al. | |
| 5,725,119 | A | 3/1998 | Bradford et al. | |
| 5,813,566 | A | 9/1998 | Bradford et al. | |
| 5,815,903 | A | 10/1998 | Foster et al. | |
| 6,062,410 | A | 5/2000 | Bradford et al. | |
| 6,164,440 | A | 12/2000 | Van Bree | |
| 6,202,884 | B1 | 3/2001 | Verkerke | |
| 6,230,916 | B1 | 5/2001 | Bradford et al. | |
| 6,305,764 | B1 | 10/2001 | Kortman et al. | |
| 6,352,157 | B1 | 3/2002 | Srinivasan | |
| 6,540,096 | B1 | 4/2003 | Bazany et al. | |
| 6,830,156 | B2 | 12/2004 | MacKelvie | |
| 7,125,062 | B2 | 10/2006 | Kiester et al. | |
| 7,322,485 | B2 | 1/2008 | Bradford et al. | |
| 7,748,559 | B2 | 7/2010 | Bradford | |
| 7,762,422 | B2 | 7/2010 | Dobrinski | |
| 7,870,970 | B2 | 1/2011 | Fisk | |
| 8,100,282 | B2 | 1/2012 | Nyeboer et al. | |
| 8,308,015 | B2 | 11/2012 | Bradford et al. | |
| 8,607,978 | B2 * | 12/2013 | Bradford | B65D 19/44 206/335 |
| 9,004,307 | B2 | 4/2015 | Bradford et al. | |
| 9,010,563 | B2 | 4/2015 | Bradford et al. | |
| 9,016,507 | B2 * | 4/2015 | Bradford | B65D 19/06 206/461 |
| 9,051,112 | B2 | 6/2015 | Sanger | |
| 9,051,113 | B2 | 6/2015 | Sanger | |
| 9,211,999 | B2 | 12/2015 | Bublitz et al. | |
| 9,422,081 | B2 | 8/2016 | Bublitz et al. | |
| 2003/0168461 | A1 | 9/2003 | Richardson | |
| 2006/0048486 | A1 * | 3/2006 | Laing | A23L 3/001 53/469 |
| 2006/0249415 | A1 | 11/2006 | Nyeboer et al. | |
| 2006/0249416 | A1 | 11/2006 | Bradford et al. | |
| 2006/0249514 | A1 | 11/2006 | Bazany et al. | |
| 2006/0249515 | A1 | 11/2006 | Dobrinski | |
| 2006/0278646 | A1 | 12/2006 | Bradford | |
| 2008/0023470 | A1 * | 1/2008 | Bradford | B65D 19/18 220/1.5 |
| 2008/0078729 | A1 | 4/2008 | Bazany et al. | |
| 2012/0043865 | A1 | 2/2012 | Newkirk et al. | |
| 2012/0061387 | A1 | 3/2012 | Nam | |
| 2013/0057135 | A1 | 3/2013 | Bradford et al. | |
| 2013/0175912 | A1 | 7/2013 | Bradford et al. | |
| 2014/0076755 | A1 | 3/2014 | Bradford et al. | |
| 2015/0101956 | A1 | 4/2015 | Dobrinski et al. | |

FOREIGN PATENT DOCUMENTS

| | | |
|---|---|---|
| DE | 20318172 | 5/2004 |
| FR | 1455414 | 4/1966 |
| FR | 2860504 | 4/2005 |
| JP | 6-59230 | 8/1994 |
| WO | 9310024 | 5/1993 |

* cited by examiner

CONTAINER HAVING NON-LINEAR AND LINEAR TRACKS FOR SUPPORTING MOVABLE DUNNAGE

CROSS REFERENCE TO RELATED APPLICATIONS

This application is a continuation of U.S. patent application Ser. No. 14/848,920 filed Sep. 9, 2015, a continuation-in-part of U.S. patent application Ser. No. 14/081,439 filed Nov. 15, 2013, now U.S. Pat. No. 9,211,999, each being fully incorporated by reference herein.

FIELD OF THE INVENTION

The present invention relates to containers for use in shipping and, more particularly, to containers with movable members for supporting product.

BACKGROUND OF THE INVENTION

A large number of different container structures are utilized by manufacturers to ship a variety of different products to end users, which may be, for example, assembly plants. In the automobile industry, for example, an assembly plant assembling a particular automobile might utilize a number of different parts from different manufacturers. These manufacturers ship their respective parts to the assembly plant in container structures where the parts are then removed from dunnage or support members inside the container structure and assembled into a finished automobile.

Access to the product in the containers is of particular concern. Specifically, in the automotive industry, the containers full of product are positioned on an assembly line adjacent to a work area, which is associated with a particular product to be installed on a manufactured vehicle. For example, a container full of interior door panels is usually positioned next to a particular station on an assembly line where interior door panels are installed so that a line worker may easily access the door panels inside the container. The product or part is taken directly from the container and used on the line. Some existing containers are difficult to access, which makes removal of the parts therein difficult and time-consuming. For example, some containers are configured so that a line worker must walk around the container to remove parts or products from opposite ends of the container. As may be appreciated, a line worker only has a certain amount of time to install a part. Any delay in access and removal of the part from the container is undesirable.

In many containers, a line worker or employee must insert or remove parts from a distal or rear part of the container. The size and/or weight of the parts or workpieces may cause stress or strain on the line worker and, more particularly, on the back of the worker when inserting or removing parts from such a container. Such ergonomically unfriendly movements may cause physical trauma, pain and other injuries that may lead to lost production time.

In some situations, in order to alleviate such stress and/or strain on his or her body, the line worker may move to the rear or opposite end of the container to remove parts from inside the container. This requires space around the container which may not be available, depending on the physical layout of the plant or facility. The length (front to back) of certain containers may be limited because the container manufacturer needs to eliminate the need for a line worker to walk around the container to remove product from inside the container. Such containers having a reduced length reduce the number of parts or products which may be shipped and/or stored in the container. The more containers needed to ship a predetermined number of parts, the greater the cost to the shipper.

In other containers, a line worker or employee must lean forward and bend down into the container to insert or remove a part or workpiece from a lower portion of the container. This movement by the line worker is ergonomically unfriendly because the line worker must lean forward and bend down and lift a part or workpiece up and over a wall into the container to remove the part or workpiece from inside the container. Similarly, when a part or workpiece must be inserted into a container, the line worker may have to lean forward and insert the part, which may be heavy, into its proper location inside the container, again experiencing ergonomically unfriendly movements. Such movements may be necessary with many top loading containers and/or containers having multiple layers or levels of parts.

Depending upon the number of times the line worker repeats this unnatural motion into the interior of the container, strain in the back, legs and arms may result. The size and/or weight of the parts or workpieces may increase the strain on the line worker. Thus, simply removing multiple parts during a work day may cause physical trauma, pain and other injuries that may lead to lost production time.

Accordingly, there is a need for a container which prevents employees from walking around the container to insert or remove product from inside the container.

There is further a need for a container which prevents employees from having to perform difficult or straining repetitive reaching motions.

There is further a need for a container which brings product into an ergonomically friendly area or zone for insertion or removal of the product.

SUMMARY OF THE INVENTION

The present invention provides a container for holding product therein during shipment. The container comprises a base and two opposed sides. The base and sides may be part of a metal frame or part of a plastic pallet box. In some embodiments, a plurality of track supports may be supported by the container. In some instances, multiple track supports may be secured to each of the opposed sides of the container. A plurality of tracks may be secured to the track supports on each of the opposed sides of the container. At least one of the tracks on each side may be non-linear. For purposes of this document, a non-linear track includes, but is not limited to, a generally U-shaped track and/or a generally C-shaped track and/or a generally J-shaped track. In one embodiment, the container has two tracks on each side of the container, an upper non-linear, generally U-shaped track and a linear or straight track below the upper non-linear, generally U-shaped track.

Each of the generally U-shaped tracks comprises two generally parallel portions joined by a connecting portion. The parallel portions may be generally horizontally oriented and the connecting portion may be generally vertically oriented. Each of the generally U-shaped tracks may have an upper portion extending from front to back inside the container proximate an upper edge of the container and a lower portion extending from front to back inside the container spaced apart from the upper portion. The upper and lower portions may be joined by a connecting portion located at the front of the container.

The container further comprises a plurality of movable dunnage supports supported by the tracks. Each dunnage support extends between opposed tracks of the same layer or level. For purposes of this document, the term "dunnage support" may be a unitary member or multiple components secured together in an assembly. For example, a "dunnage support" may comprise in combination a tubular middle member and a pair of end members which move inside or along stationary tracks or track assemblies. A dunnage support may be a single member, such as those disclosed in U.S. Pat. No. 9,120,597, which is fully incorporated by reference herein. The tracks and other components may also be those disclosed in U.S. Pat. No. 9,120,597.

For purposes of this document, the term "track" may be a unitary member or multiple components secured together. The present invention is not intended to be limited to the tracks like those illustrated and described herein. For example, a "track" may comprise a rail attached to one or more sides of a container or a groove therein. The term "track" is intended to include any number of stationary objects along which dunnage supports, as defined and/or illustrated herein, may slide or move during the loading or unloading of products from dunnage inside the container.

The container further comprises dunnage supported by the dunnage supports. The dunnage may be pouches or any other known dunnage. The dunnage may be secured to the dunnage supports in any known manner, such as sewing.

The container further comprises a movable shelf assembly comprising multiple components. In one embodiment of movable shelf assembly, a first or front portion may move rearwardly over a stationary second or rear component after the first component is loaded with empty dunnage so as to create an opening to allow an operator to remove products from a lower level or layer of dunnage. For loading purposes, the movable first component of the movable shelf assembly may be moved forwardly over a stationary second or rear component to move the emptied dunnage towards the front of the container to a more ergonomically friendly position for the operator to load the upper layer or level of dunnage.

According to another aspect of the present invention, the container has a base and opposed sides. The base and sides may be part of a metal frame or part of a plastic pallet box. The container further comprises a plurality of tracks supported by each of the opposed sides of the container at different levels. At least one of the tracks on each side of the container may be non-linear and anther track may be generally linear. In one embodiment, at least one of the non-linear tracks is generally U-shaped. A plurality of movable dunnage supports extend between opposed tracks of each level and movable along corresponding tracks. In some embodiments, each of the dunnage supports comprises a pair of end members movable along the tracks and a middle member extending between the end members and secured to each end member. Pouches are supported by the dunnage supports.

The container further comprises a movable shelf assembly comprising multiple components or pieces, at least one of which is movable. The shelf assembly supporting the emptied dunnage from one of the layers or levels of the container may be easily pushed rearwardly creating an opening for an operator to remove parts or products from the next lower level or layer of dunnage. An operator located at the front of the container may pull product to be emptied from the rear of the container forwardly to a more ergonomically friendly position after products suspended from dunnage at the front of the container have been unloaded or removed. Thus, a person unloading the container from the front or proximal location of the container will not have to stretch or reach to the back of the container to unload remaining product.

Similarly, a person loading the container from the front of the container need not stretch or reach to the back of the container to insert or load product into the container. The loader of the container may push the dunnage supports and associated dunnage loaded with product rearwardly and load additional product in a more ergonomically friendly position or manner. For example, after product is loaded into dunnage suspended by adjacent dunnage supports, these dunnage supports and associated dunnage are pushed rearwardly to enable the loader to load additional product. Thus, the container allows product to be more efficiently and safely removed from the container or inserted therein without unnecessary stress or strain on the operator.

The end members of the dunnage supports may be made of plastic or any other desired material. Each side of the container may have non-linear tracks along which the dunnage supports move to move dunnage supported by the dunnage supports closer to the user for loading or unloading product. Each end member may have at least one head located inside the interior of the track so the end member remains engaged with the track. The end member may have another head outside the track for preventing the dunnage material from entering the interior of the track.

Any of the tracks may have openings therein and removable caps for covering and/or closing the openings. If one or more of the dunnage supports needs to be removed or inserted, a person may remove and/or insert one or more dunnage support via the openings in opposed tracks.

The ease of operation and other objects and advantages of the present invention shall be made apparent from the accompanying drawings and the brief description thereof.

BRIEF DESCRIPTION OF THE DRAWINGS

The accompanying drawings, which are incorporated in and constitute a part of this specification, illustrate embodiments of the invention and, together with a general description of the invention given above and the detailed description of the embodiments given below, serve to explain the principles of the invention.

DETAILED DESCRIPTION OF THE INVENTION

Figure 1:
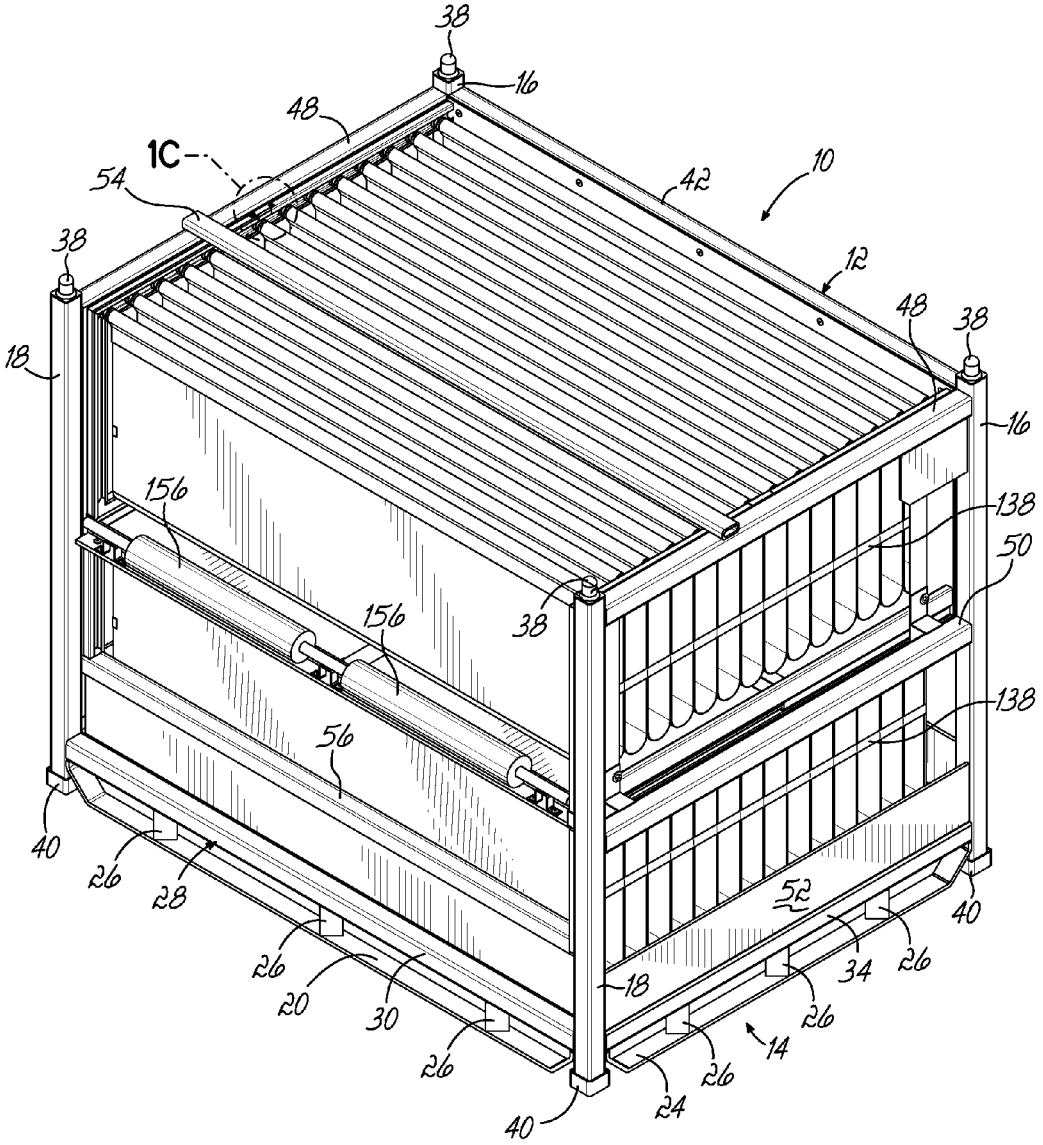
FIG. 1 is a perspective view of one embodiment of a reusable and returnable container.

Referring to FIG. 1, there is illustrated a reusable and returnable container 10 according to one embodiment. The reusable and returnable container 10, as shown, comprises an outer metal frame 12 having a base 14, two rear corner posts 16 and two front corner posts 18, all four corner posts 16, 18 extending upwardly from the base 14.

Figure 1A:
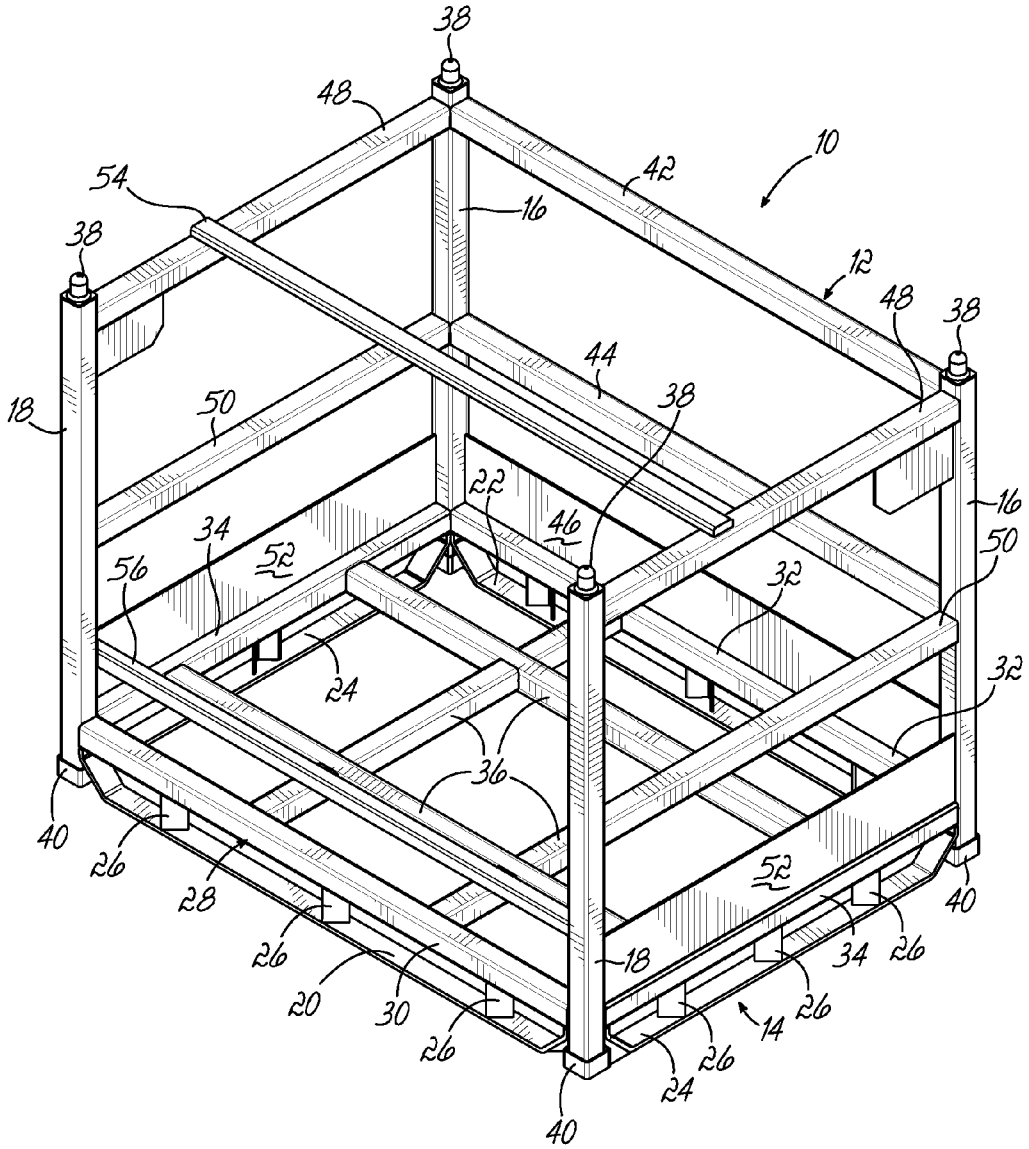
FIG. 1A is a perspective view of the frame of the container of FIG. 1.

As best shown in FIG. 1A, the base 14 is generally rectangular in shape and comprises a front perimeter member 20, a rear perimeter member 22 and two side perimeter members 24. The perimeter members of the base 14 may be secured together or secured to the corner posts 16, 18 via any conventional means, including welding. A plurality of stubs 26 extend upwardly from the base 14 and are secured thereto via any conventional means, including welding.

As best shown in FIG. 1A, a generally rectangular sub-base 28 is spaced above the base 14 by the stubs 26 and secured to the stubs 26 by any conventional means, including welding. The sub-base 28 comprises a front member 30, a rear member 32 and two side members 34. The members of the sub-base 28 may be secured together or secured to the corner posts 16, 18 via any conventional means, including welding. Although three stubs 26 are shown extending upwardly from each of the base members 20, 22 and 24 to corresponding sub-base members 30, 32 and 34, any number of stubs (or a single continuous member) may be used to space the sub-base 28 above the base 14.

Figure 2:
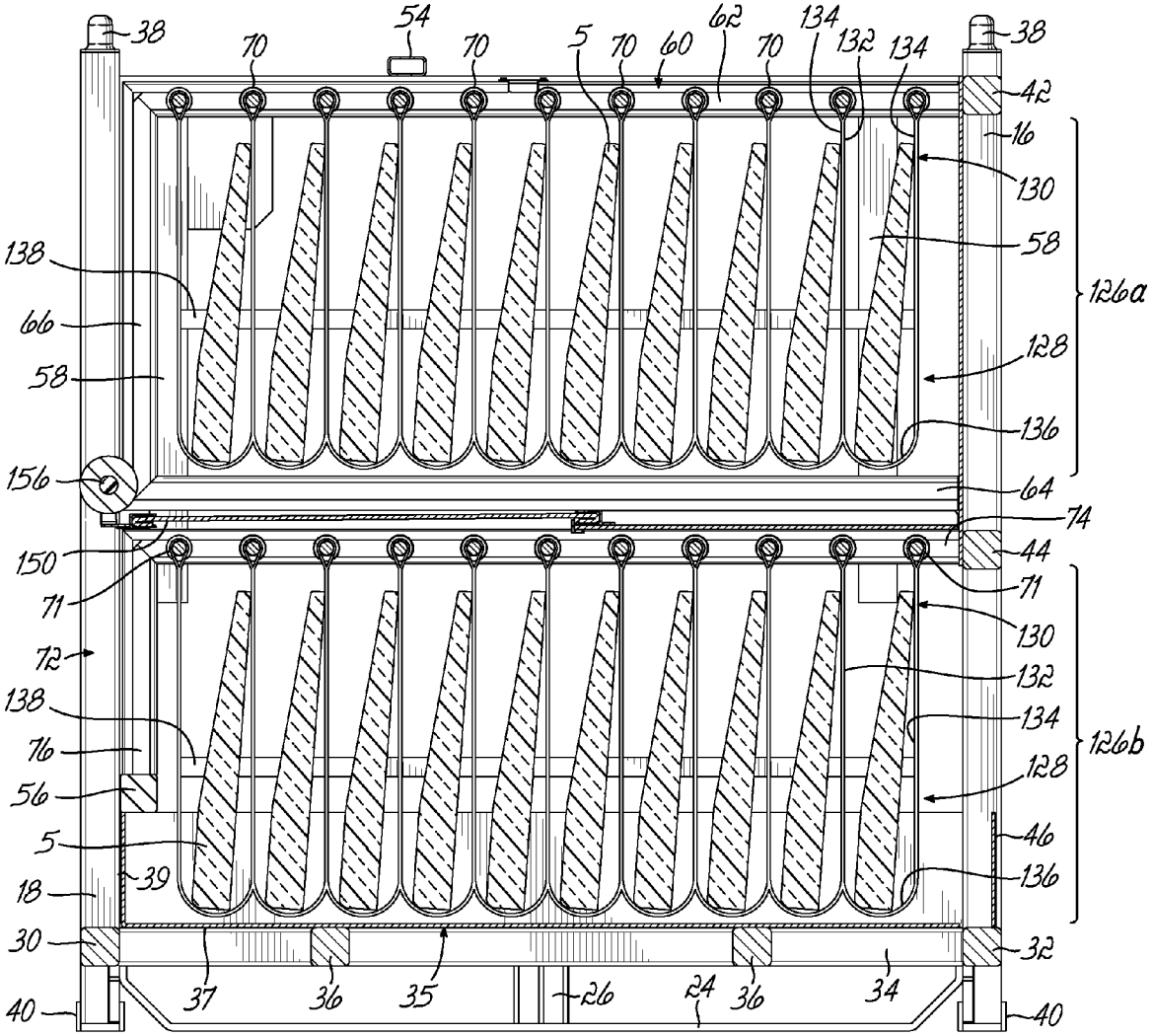
FIG. 2 is a cross-sectional view of one side of the container of FIG. 1 loaded with products.

As best shown in FIG. 1A, the sub-base 28 of the container 10 further comprises a plurality of intersecting interior members 36 extending between opposed perimeter sub-base members 30, 32 and 34 and secured thereto, interior members 36 comprising part of the sub-base 28 of the rack 12. Although four interior members 36 are shown in the sub-base 28 of the container 10, any number of interior members may be used. Each of the interior members 36 of the sub-base 28 is generally rectangular in cross-section and has a hollow interior. As best shown in FIG. 2, a floor 35 rests on top of the sub-base 28 of the rack 12. The floor 35 has a generally horizontally oriented main portion 37 resting upon the sub-base 28 of the rack 12 and a generally vertically oriented front portion 39 which may be secured to front brace 56. Although the floor 35 is shown as one folded or bent piece, it may comprise multiple pieces and may be made of any desired material. One suitable material is corrugated plastic.

As best shown in FIG. 2, each of the corner posts 16 and 18 is generally rectangular in cross-section, has a hollow interior, and a knob 38 at the top thereof for stacking purposes so that multiple containers 10 may be stacked upon one another. The knobs 38 of a first container fit inside the hollow interiors of the corner posts of another or second container located above the first container for stacking purposes. As shown in the drawings, a cap 40 adapted to receive one of the knobs 38 may be located at the bottom of each corner post.

The frame 12 further comprises an upper rear member 42, middle rear member 44 and lower rear member 46, each rear member 42, 44, 46 extending between the two rear corner posts 16 and being secured thereto. The frame 12 further comprises, on each side of the container, an upper side member 48 generally co-planar with the upper rear frame member 42, a middle side member 50 generally co-planar with the middle rear frame member 44 and a lower side member 52 generally co-planar with the lower rear frame member 42. Each of the side members 48, 50 and 52 extends between one of the rear corner posts 16 and one of the front corner posts 18 and is secured thereto.

The frame 12 further comprises a top brace 54 extending between the upper side members 48 and secured thereto by any conventional means, including welding. The frame 12 further comprises a front brace 56 extending between the front corner posts 18 and secured thereto by any conventional means, including welding. If desired, the top brace 54 and/or front brace 56 may be omitted in any of the embodiments shown or described herein.

Although one configuration of frame is illustrated, the present invention may be used with other types or configurations of frames.

Figure 1B:
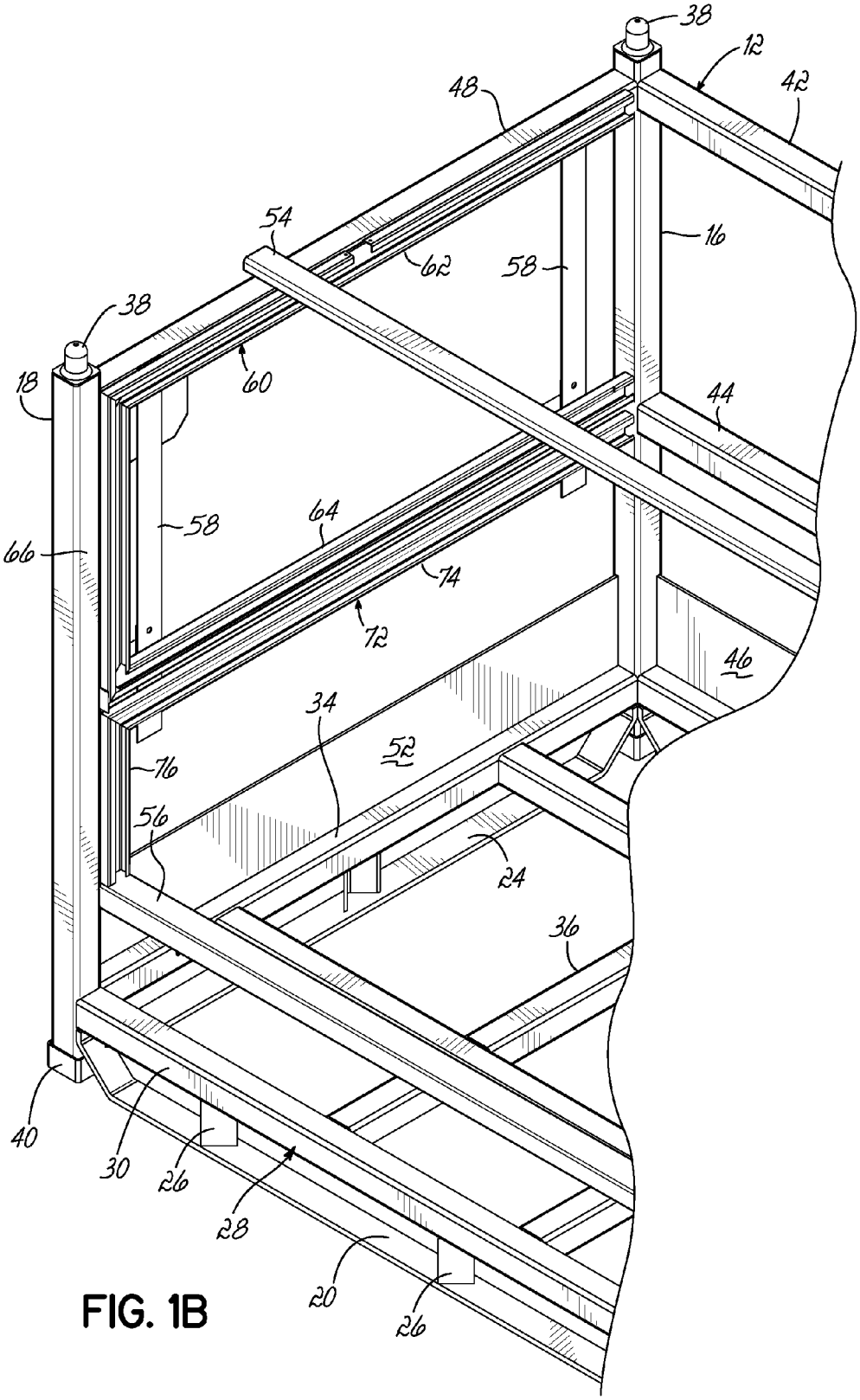
FIG. 1B is an enlarged perspective view of a portion of the container of FIG. 1 showing the tracks, but not the dunnage and dunnage supports.

As best shown in FIG. 1B, container 10 further comprises a plurality of generally vertically oriented spaced track supports 58 secured to the upper and middle side members 48, 50 on each side of container 10. The track supports 58 may be secured to the frame 12 with fasteners (not shown) or via welding. Although the drawings show two track supports 58 on each side of the container, any number of track supports may be used on each side of the container. The track supports 58 may be made of metal or any other desired material.

As shown in FIG. 1B, a stationary generally U-shaped track 60 is secured to the track supports 58 on each side of the container 10 in any desired manner, such as welding, for example. Each generally U-shaped track 60 comprises stationary generally parallel horizontally oriented upper and lower portions 62, 64, respectively, vertically spaced apart from each other at different levels. A connecting portion 66 joins the generally parallel upper and lower linear portions 62, 64, respectively, of each generally U-shaped track 60 on each side of the container. The connecting portion 66 of the generally U-shaped track 60 comprises a generally vertically oriented piece welded or otherwise secured to the upper and lower portions 62, 64, respectively, of each generally U-shaped track 60. Each connecting portion 66 is shown secured to one of the front corner posts 18 on each side of container 10. Each connecting portion 66 of non-linear track 60 may be secured to one of the front corner posts 18 in any known manner, such as welding, for example. As disclosed in U.S. patent application Ser. No. 14/054,271, which is fully incorporated by reference herein, the connecting portion 66 of each generally U-shaped track 60 may have a bump (not shown) located at the front of the upper portion 62 to aid in keeping the dunnage supports 70 in the upper portion 62 of the generally U-shaped track 60.

On each side of the container 10, a stationary generally L-shaped lower track 72 is secured to the track supports 58 in any desired manner, such as welding, for example. Each generally L-shaped lower track 72 is spaced below the lower linear portion 64 of the generally U-shaped track 60. As shown in FIGS. 1B and 2, each L-shaped lower track 72 has a first generally horizontally oriented portion 74 extending from front to back inside the container and a second generally vertically oriented portion 76 extending from top to bottom inside the container. As shown in FIG. 1B, the first generally horizontally oriented portion 74 of each generally L-shaped lower track 72 is below and generally parallel the lower linear portion 64 of the generally U-shaped track 60 when the container is in its position shown in FIG. 1. For purposes of this document, the description of the positioning of various components is described with respect to the container 10 being in the position illustrated in FIG. 1.

Figure 1C:
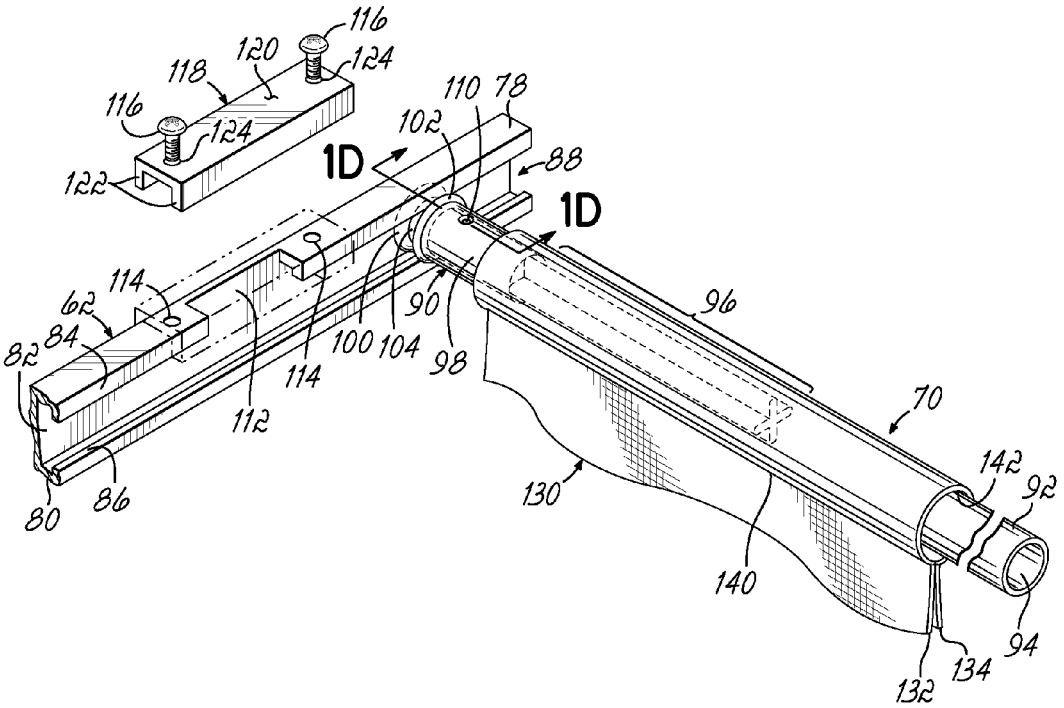
FIG. 1C is an enlarged view of the encircled area 1C of FIG. 1.

Each generally U-shaped track 60 and each generally L-shaped track 72 is fixed in a stationary position on one side of the container. The tracks are arranged in corresponding pairs at the same vertical levels. Each track may be one-piece or multiple pieces. Although the drawings disclose one generally U-shaped track 60 and one generally L-shaped track 72 on each side of the container, the container may have any number of different levels or layers of tracks. As best shown in FIG. 1C, each of the straight upper and lower portions 62, 64, respectively, of the generally U-shaped track 60, along with the lower generally L-shaped track 72, may have an opening therein covered with a cover.

As best shown in FIG. 1C, each generally U-shaped track 60, along with each lower L-shaped track 72 has an upper wall 78, a lower wall 80 joined to the upper wall 78 by a side wall 82, and a lip 84 extending downwardly from the upper wall 78 and another lip 86 extending upwardly from the lower wall 80 defining an interior 88 of the upper portion 62 of generally U-shaped track 60.

Referring to FIG. 2, container 10 further comprises a plurality of upper dunnage supports 70, each dunnage support 70 extending between the upper linear portions 62 of the generally U-shaped tracks 60 at the same level on opposed sides of the container. As shown in FIG. 2, container 10 further comprises a plurality of lower dunnage supports 71, each lower dunnage support 71 extending between the generally L-shaped tracks 72 at the same level on opposed sides of the container.

As shown in FIG. 1C, dunnage support 70, along with each of the other dunnage supports, 70, 71 includes a pair of end members 90 and a tubular middle member 92 having a hollow interior 94 extending therebetween. The end members 90 are preferably made of injection molded plastic, such as nylon, but may be made of any other material. The tubular middle member 92 is preferably made of metal, but may be made of other suitable material, such as plastic.

As shown in FIG. 1C, each end member 90 preferably has a first portion 96 having an X-shaped cross-sectional configuration and a second portion 98 having a circular cross-sectional configuration. Although one configuration of end member 90 is illustrated, any type or configuration of slider may be used with the present invention. In this embodiment, each end member 90 has a pair of heads 100, 102 at the end of the end member 90. Head 100 is furthest from the first portion 96 of the end member 90, and head 102 is spaced inwardly from head 100. The heads 100, 102 are spaced from one another to define a groove 104 therebetween which receives and retains the lips 84, 86 of either the generally U-shaped track 60 or the lower generally L-shaped track 72. As shown in FIG. 1C, head 100 is located inside the interior 88 of either the generally U-shaped track 60 or the lower generally L-shaped track 72, and head 102 is located outside the interior 88 of either the generally U-shaped track 60 or the lower generally L-shaped track 72. Head 100 keeps the end member 90 engaged with the track, while head 102 keeps the dunnage material out of the interior 88 of the track, thereby ensuring that the end members 90 may move smoothly along either the generally U-shaped track 60 or the lower generally L-shaped track 72. Although one configuration of dunnage support is illustrated, the present invention may be used with any type or configuration of dunnage support for supporting dunnage so the dunnage may slide or move inside the container.

Figure 1D:
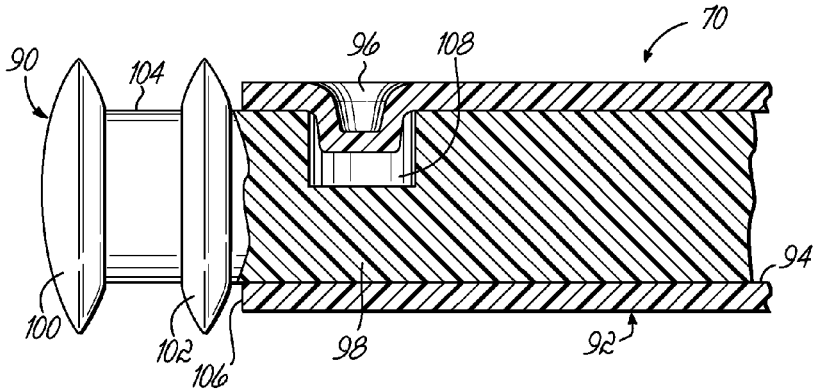
FIG. 1D is a cross-sectional view taken along the line 1D-1D of FIG. 1C.

As shown in FIG. 1D, each end of tubular middle member 92 fits over at least one portion 98 of an end member 90. An end surface 106 of tubular middle member 92 abuts head 102 of end member 90. Each end member 90 of each dunnage support 70, 71 is adapted to engage and move along one of the tracks. The end members 90 preferably slide along the length or width of the tracks; however, different end members may rotate rather than slide along the tracks. Although one configuration of track and end member is shown and described, other types of end members and tracks may be used if desired.

As best shown in FIG. 1D, dunnage support 70, along with each of the other dunnage supports 70, 71, includes a pair of end members 90 (only one being shown in FIG. 1D).

Each end member 90 has a groove 108 formed in a portion 98 therein. Dunnage support 70, along with each of the other dunnage supports 70, 71, further includes a tubular middle member 92 having a hollow interior 94 extending therebetween. As shown in FIG. 1C, each end of tubular middle member 92 fits over at least one portion 96 of an end member 90. An end surface 106 of tubular middle member 92 abuts head 102 of end member 90. The tubular middle member 92 is preferably made of metal, but may be made of other suitable material, such as plastic. As shown in FIG. 1D, tubular middle member 92 has two detents 110 therethrough (one at each end) in which the material of the tubular middle member 92 is pressed downwardly into the groove 108. This attachment between each of the two end members 90 and the tubular middle member 92 enables some movement therebetween. Such interaction between the end members 90 and tubular middle member 92 allows for a tolerance of approximately one-quarter inch on each side. The detents 110 prevent separation of the tubular middle member 92 from the end members 90 while allowing some movement therebetween as the detents 110 move within the grooves 108 formed in the end members 90.

FIG. 1C illustrates a dunnage support 70 used to support one side of one of the pouches. However, FIG. 1C illustrates another innovative feature or aspect of the invention. Upper portion 62 of generally U-shaped track 60 has an opening or cut-out 112 formed therein. Holes 114 are formed in the upper wall 78 of the upper portion 62 of generally U-shaped track 60, which are sized and threaded to receive fasteners 116. Although fasteners 116 are illustrated to be screws, they may be any other desirable fastener. A cap 118 is removably secured to the upper portion 62 of generally U-shaped track 60 to cover the opening or cut-out 112. As best seen in FIG. 1C, cap 118 has a generally inverted U-shaped cross-sectional configuration, including a top portion 120 and side portions 122 extending downwardly from the top portion 120. Holes 124 are formed through the top portion 120 of the cap 118 and sized to receive fasteners 116, as shown in FIG. 1C. The fasteners 116 are adapted to pass through the holes 124 in the cap 118 and into the holes 114 in the upper wall 78 of the upper portion 62 of generally U-shaped track 60. Caps of alternative shapes or sizes may be used if desired.

When one of the end members 90 or any part of any of the dunnage support is damaged or needs to be replaced for any reason, one may remove cap 118 after loosening fasteners 116, thereby exposing the opening or cut-out 112 of the upper portion 62 of generally U-shaped track 60. The damaged dunnage support may then be removed or inserted as necessary to repair or replace the damaged part or parts. The lower generally L-shaped track 72, or any track described or illustrated herein, may have the same cut-out and cap for the same purpose.

As best shown in FIG. 2, container 10 comprises two layers or levels 126*a*-126*b* of vertically spaced dunnage 128, each level being in the form of a plurality of pouches 130, and are suspended by and supported by a plurality of dunnage supports. As shown in FIG. 2, each pouch 130 has a front wall 132, a rear wall 134, a bottom wall 136 and two elastic straps 138 extending therebetween (one on each side). The straps 138 may be made of nylon or any other elastic material. In some applications, the elastic straps 138 may be omitted. As shown in FIG. 2, the top of the pouch front wall 132 is attached to one of the dunnage supports, and the pouch rear wall 134 is attached to an adjacent dunnage support. Although the dunnage 128, as shown, comprises pouches, the dunnage may assume other shapes or configurations. A pouch 130 is supported by two adjacent dunnage supports. As shown in FIG. 1C, the fabric of the pouch 130 is sewn or otherwise secured together along a seam 140 to make a pocket 142 in which is located a tubular middle member 92 of the dunnage support.

Dunnage supports supporting pouches 130 are adapted to move from back to front inside the interior of the container 10, the end members 90 of the dunnage supports moving along the non-linear stationary tracks 60, 72.

Multiple pouches 130 are shown being formed or created from one piece of material draped or laying over multiple dunnage supports and secured to itself along seams 140 as shown in FIG. 1C. Alternatively, each pouch 130 may be made from its own piece of material, in which case, the pouches 130 would not be interconnected other than via straps or space limiters (not shown).

Figure 2A:
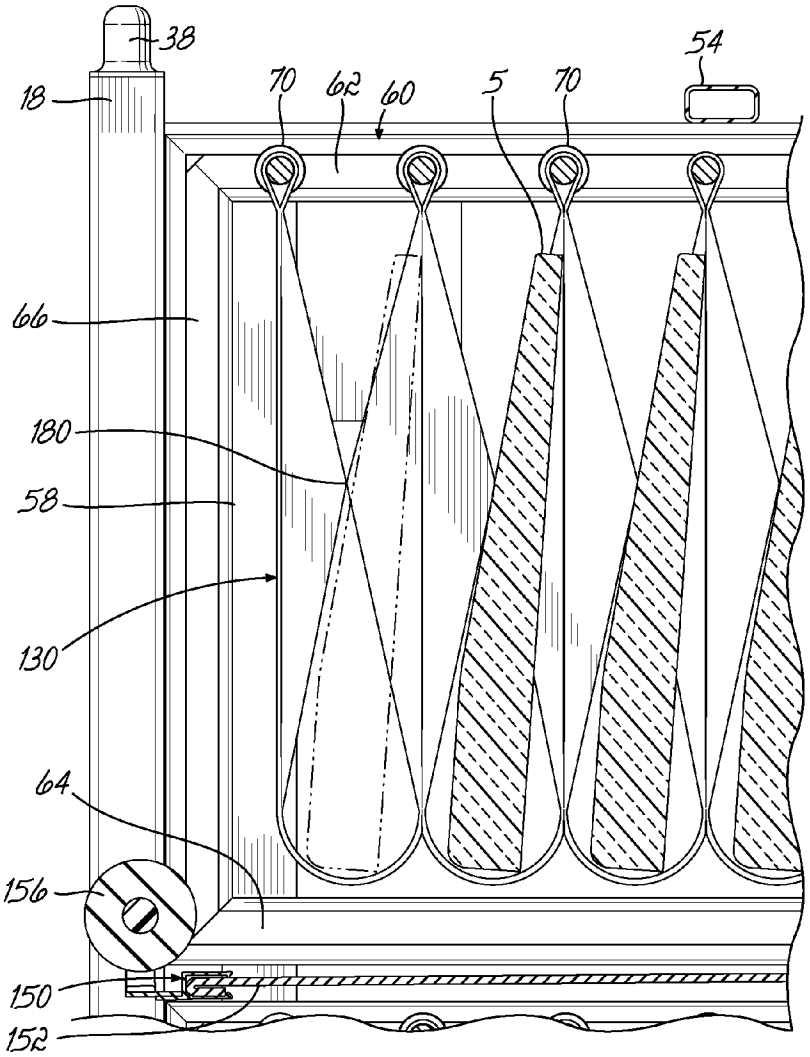
FIG. 2A is a cross-sectional view showing an alternative form of dunnage which may be used inside any container described or illustrated herein.

As shown in FIG. 2A, straps 138 may be omitted and replaced with two side sewn locations 180 (only one being shown in FIG. 2A). Each pouch 130 has two sewn locations 180 on opposite sides of the pouch 130, thereby enabling the product 5 to be inserted or removed as desired. Each sewn location 180 comprises the front and rear walls 132,134 of pouch 130 being sewn together at a specific location. Although the drawings show the vertically oriented portions between adjacent pouches appearing to be a single ply, each vertically oriented portion is actually two plies, one of the plies being the front wall 132 of one pouch 130 and the ply being the rear wall 134 of another pouch 130. See FIG. 1C.

Figure 3A:
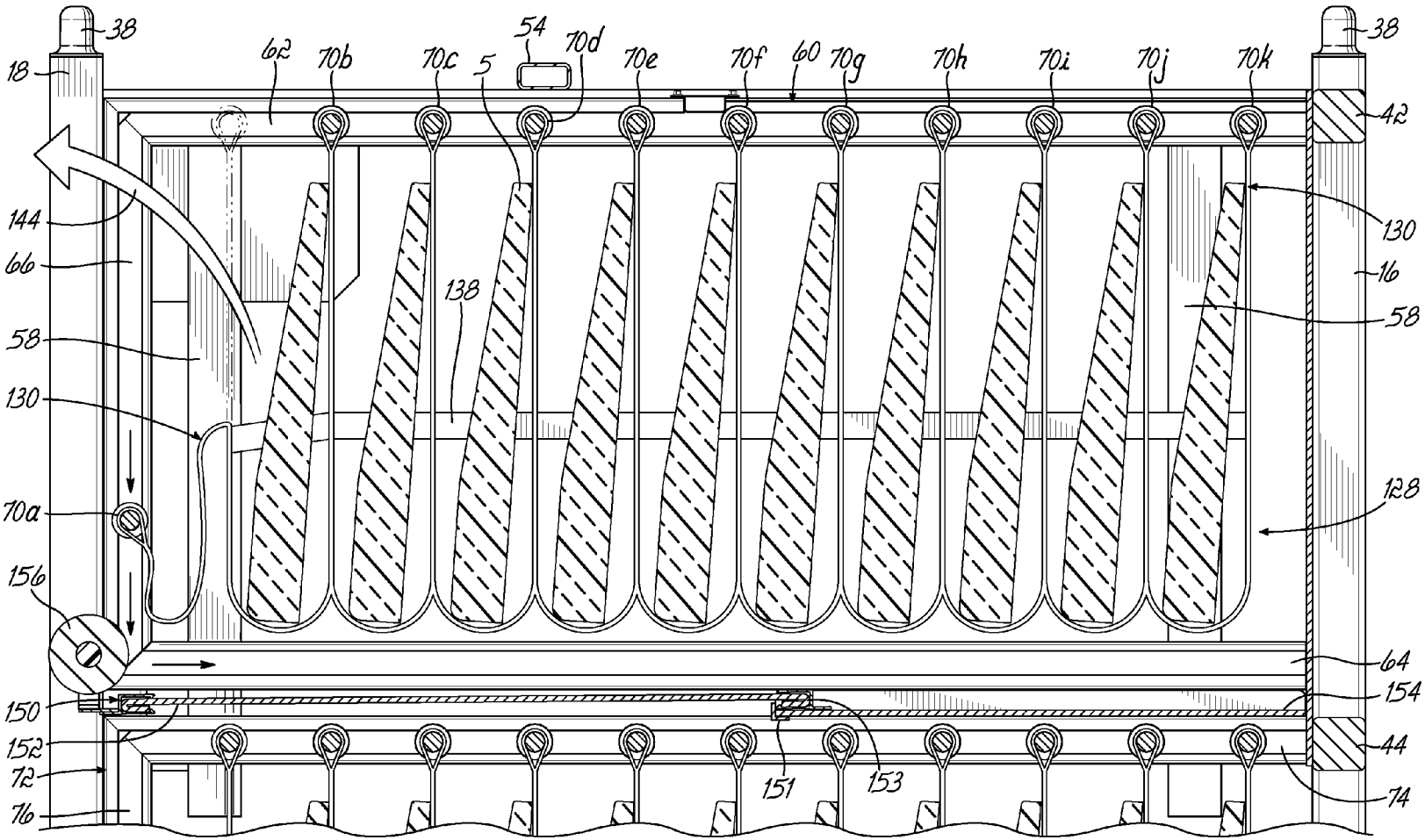
FIG. 3A is a cross-sectional view of a portion of the container of FIG. 1, showing the front product of an upper layer of products being removed.

FIGS. 3A-3E illustrate a method of unloading product 5 from the pouches 130 of the container 10. This unloading method comprises the first step of moving the front upper dunnage support 70*a* of the upper dunnage supports 70*a*-70*k* extending between the upper portions 62 of generally U-shaped tracks 60 from its position shown in FIG. 2 into the connecting portions 66 of the generally U-shaped tracks 60 to a position shown in FIG. 3A. As shown in FIG. 3A, the next step comprises removing the front product 5 (closest to the front of the container) out of the dunnage pouch 130 in the upper or top level of dunnage 126*a* in the direction of arrow 144.

Figure 3B:
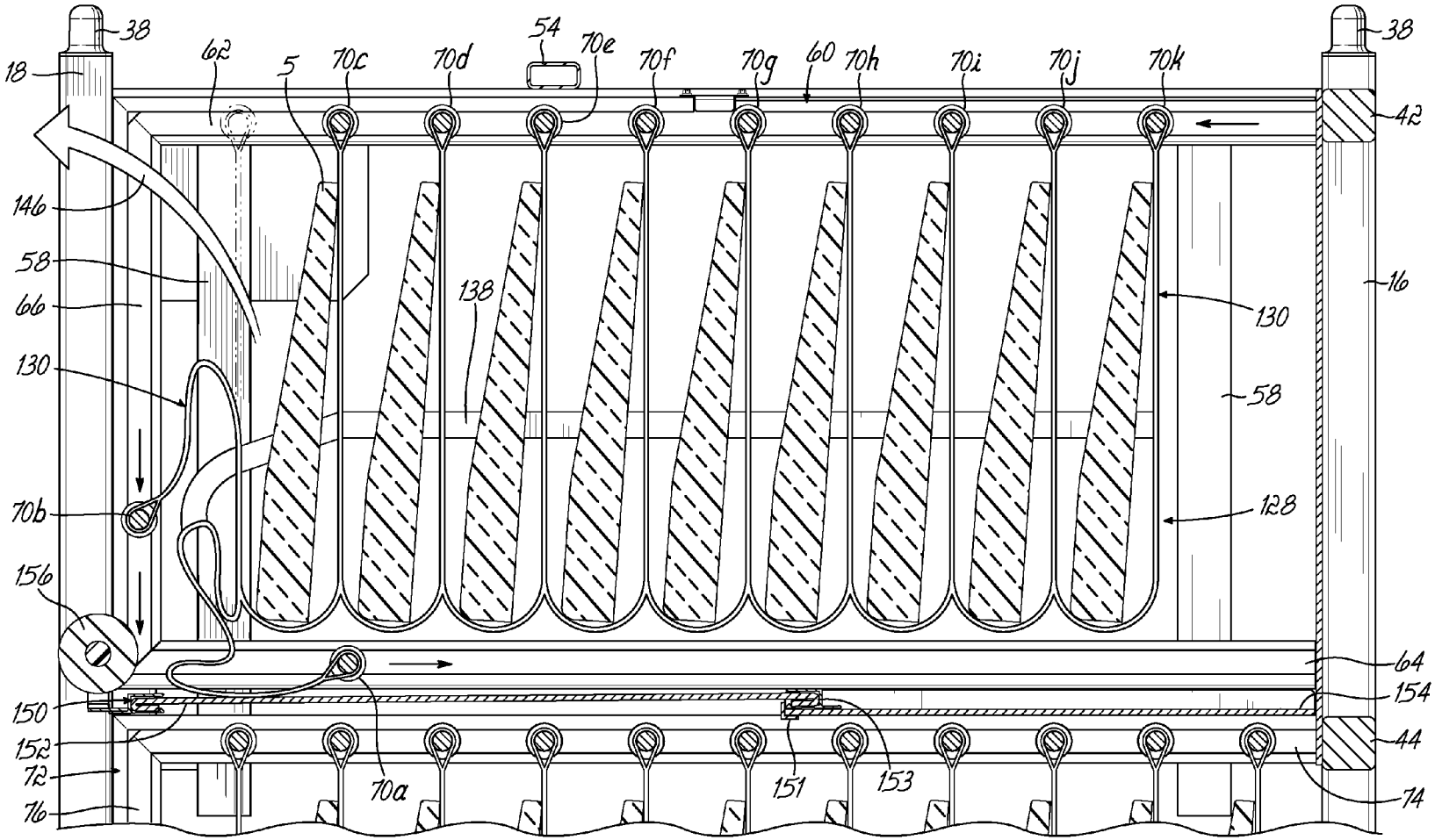
FIG. 3B is a cross-sectional view of a portion of the container of FIG. 1, showing a second product of the upper layer of products being removed.

As shown in FIG. 3A, when front upper dunnage support 70*a* is located extending between the connecting portions 66 of the generally U-shaped tracks 60, and next dunnage support 70*b* is located extending between the upper portions 62 of the generally U-shaped tracks 60, an operator may easily remove a product inside the front pouch 130 because the front dunnage support 70*a* is below the next dunnage support 70*b*. As shown in FIG. 3B, this is also true as regards dunnage supports 70*b*, 70*c* when an operator is unloading a second product 5 from the upper layer of dunnage. This orientation of the dunnage supports 70*a*-70*k* due to the configuration of the generally U-shaped tracks 60 helps an operator from an ergonomic standpoint, reducing the stress and strain on the body of the operator when unloading product from the upper layer or level of dunnage. Thus, the unique configuration of the upper generally U-shaped tracks 60 inside the container 10 may reduce the container owner's costs because workers or operators may have fewer injuries/days off due to injury.

As shown in FIG. 3B, the next step comprises moving dunnage support 70*b* (second from the front) from its position extending between the upper portions 62 of the generally U-shaped tracks 60 (shown in FIG. 3A) into the connecting portions 66 of the generally U-shaped tracks 60. In addition, the front dunnage support 70*a* is moved from its position shown in FIG. 3A extending between the connecting portions 66 of generally U-shaped tracks 60 to a position shown in FIG. 3B extending between the lower portions 64 of the generally U-shaped tracks 60. During this step, the front dunnage support 70*a* moves toward the rear of the container, the end members 90 of dunnage support 70*a* moving along the lower portions 64 of the generally U-shaped tracks 60.

Figure 3C:
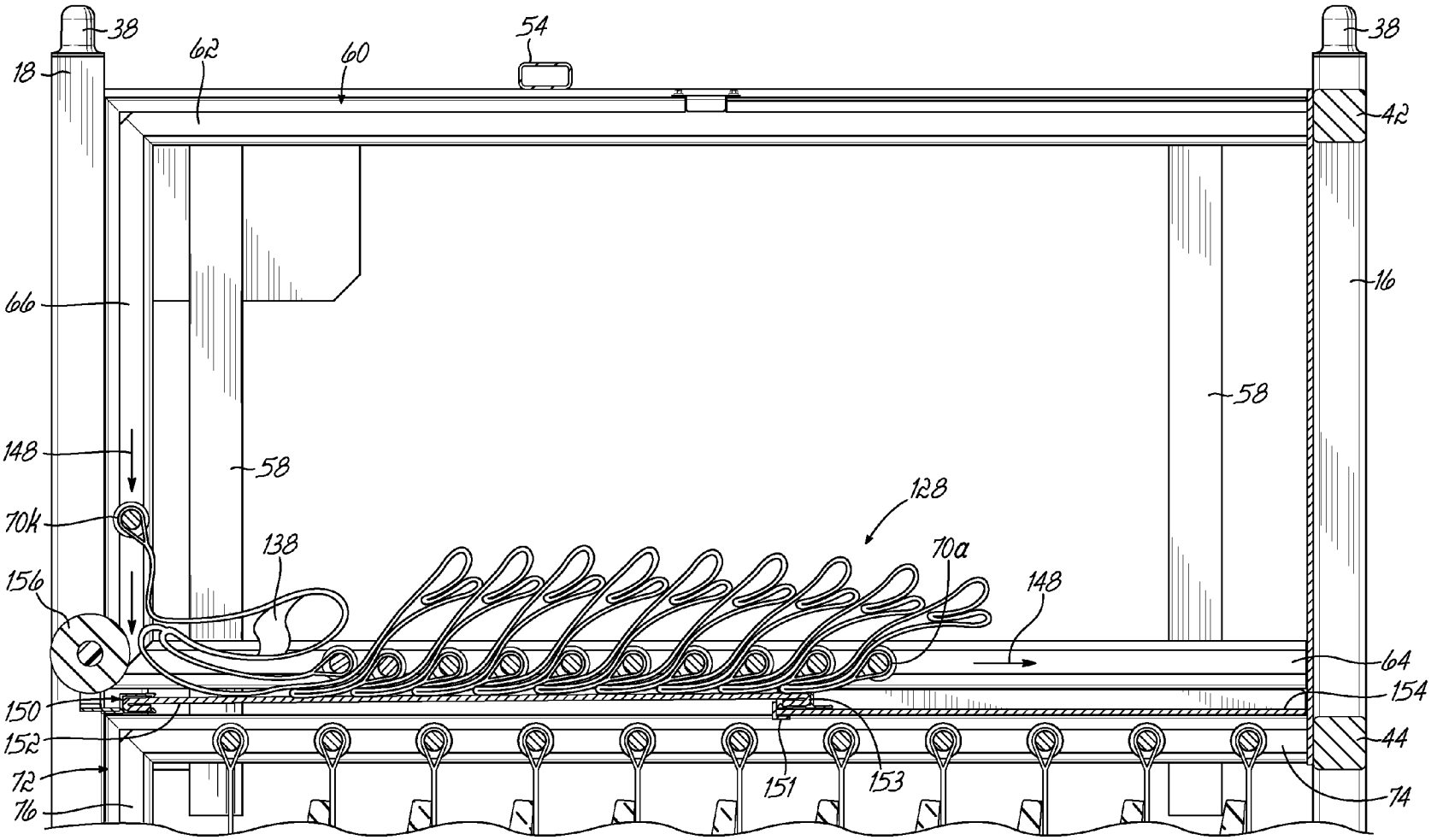
FIG. 3C is a cross-sectional view of a portion of the container of FIG. 1, showing the upper layer of dunnage being empty and residing on a shelf assembly.

As shown in FIG. 3B, the next step comprises removing another product 5 from the other pouch 130 of the upper or top level of dunnage 126*a* in the direction of arrow 146. Each time a product 5 is removed from a pouch 130 of the upper level of dunnage 126*a*, the upper dunnage supports and associated dunnage are moved along the generally U-shaped tracks 60 in a generally counter-clockwise direction, as shown in FIG. 3A-3C. During this unloading process, the end members 90 at the ends of the dunnage supports move along the generally U-shaped tracks 60, as shown in FIGS. 3A-3C.

Although the drawings show eleven upper dunnage supports 70*a*-70*k* supporting ten pouches 130, the container may be used with any number of upper dunnage supports and any number of pouches in the upper level of dunnage 126*a*. Similarly, although the drawings show eleven lower dunnage supports 71*a*-71*k* supporting ten pouches 130, the container may be used with any number of lower dunnage supports and any number of pouches in the lower level of dunnage 126*b*. The amount of dunnage supports and pouches may be different in each level and need not be identical.

As shown in FIG. 3C, once all of the product 5 in the pouches 130 of the top level of dunnage 126*a* have been removed, the operator moves the upper dunnage supports 70*a*-70*k* along with associated empty pouches 130 of the top level of dunnage 126*a* rearwardly along the lower portions 64 of generally U-shaped tracks 60 in the direction shown by arrows 148 to a resting position on top of a two-piece shelf assembly 150. The shelf assembly 150 comprises a movable front piece or component 152 and a stationary rear piece or component 154. As shown in FIG. 1, two bumpers 156 are attached to the front of the front piece 152 of shelf assembly 150. The rear piece 154 of the shelf assembly 150 has a stop 151 along the front edge thereof which abuts a front edge of curved portion or flange 153 along the rear edge of the front piece 152 to limit forward movement of the front piece 152 of shelf assembly 150. Although one configuration of stop 151 and one configuration of flange 153 are illustrated, other configurations may be used to limit forward movement of the front piece 152 of shelf assembly 150.

FIG. 2 shows the shelf assembly 150 between the lower portions 64 of generally U-shaped tracks 60 and the generally horizontally oriented portions 74 of the generally L-shaped lower tracks 72. After all the products 5 have been removed from the top level of dunnage 126*a* and the dunnage 126*a* is stored on top of shelf assembly 150, as shown in FIG. 3C, dunnage support 70*a*, which was originally the front dunnage support of upper dunnage supports 70*a*-70*k*, is now the rear dunnage support extending between the lower portions 64 of the generally U-shaped tracks 60.

Figure 3D:
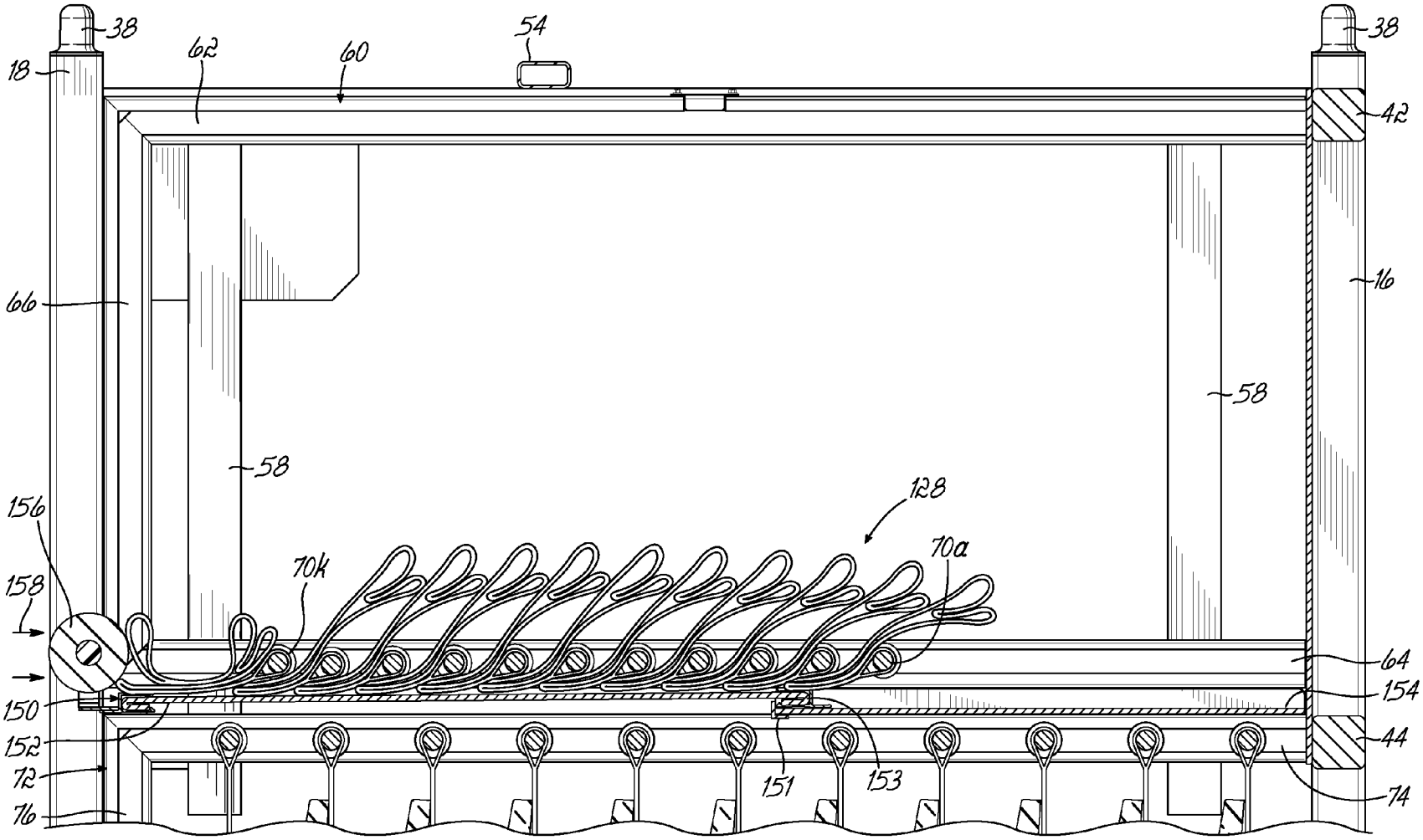
FIG. 3D is a cross-sectional view of a portion of the container of FIG. 1, showing a portion of the shelf assembly being pushed rearwardly with the upper layer of dunnage on the shelf assembly.
Figure 3E:
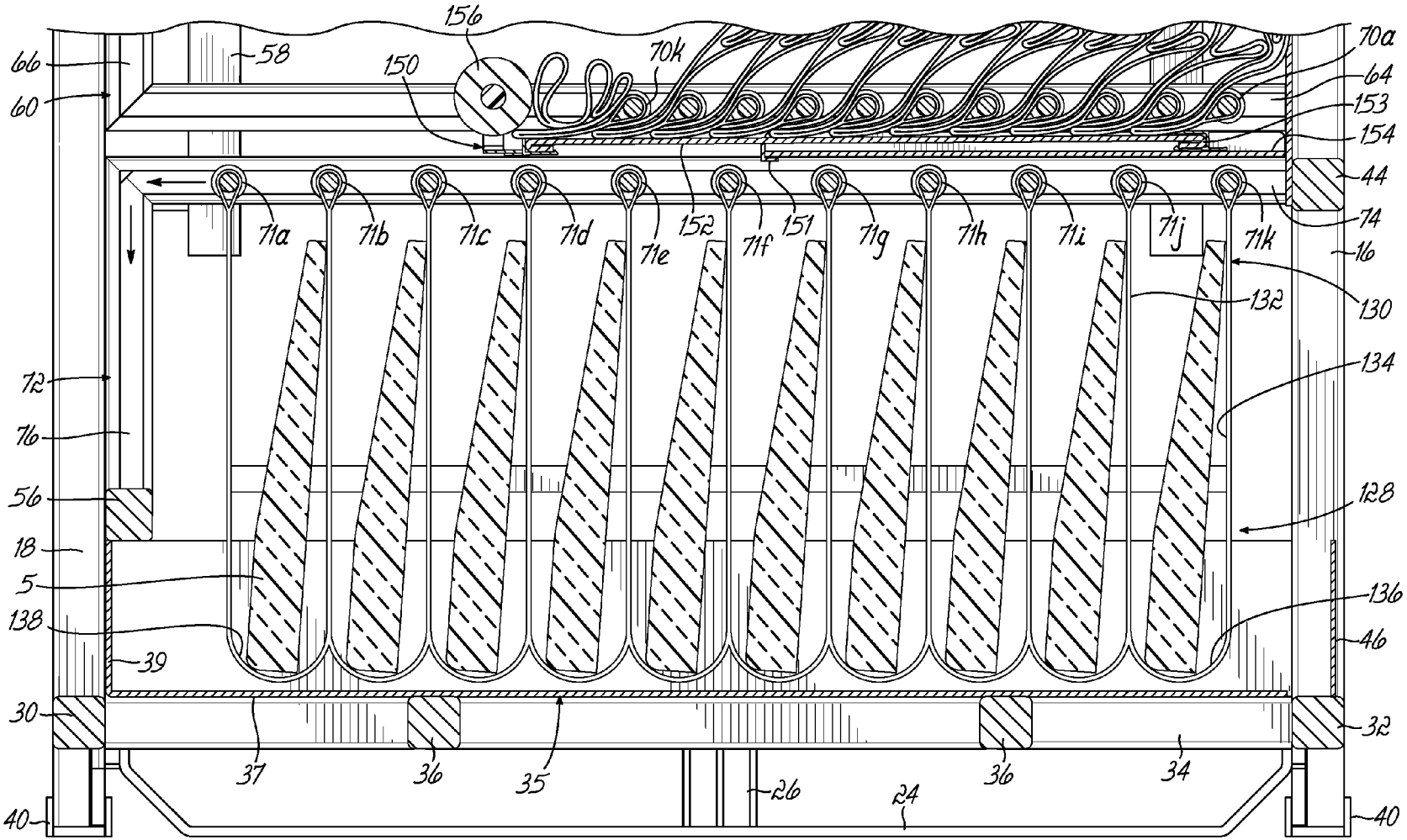
FIG. 3E is a cross-sectional view of a portion of the container of FIG. 1, showing the shelf assembly in a rear position with the upper layer of dunnage on the shelf assembly.

As shown in FIG. 3D, once all the dunnage supports 70*a*-70*k* extend between the lower portions 64 of the generally U-shaped tracks 60 and the associated upper layer of dunnage is resting on the front piece of the two-part shelf assembly 150, the bumpers 156 are pushed rearwardly in the direction of arrows 158 such that the front piece 152 of the shelf assembly 150 is over the rear piece 154 of shelf assembly 150, as shown in FIG. 3E.

As shown in FIG. 3E, the process of unloading product 5 from container 10 is continued by an operator one level at a time moving downwardly. The unloading method comprises another step of moving the front lower dunnage support 71*a* of the lower dunnage supports 71*a*-71*k* extending between the generally horizontal portions 74 of generally L-shaped tracks 72 from its position shown in FIG. 2 to a position shown in FIG. 3F extending between the generally vertically oriented portions 76 of the generally L-shaped tracks 72.

Figure 3F:
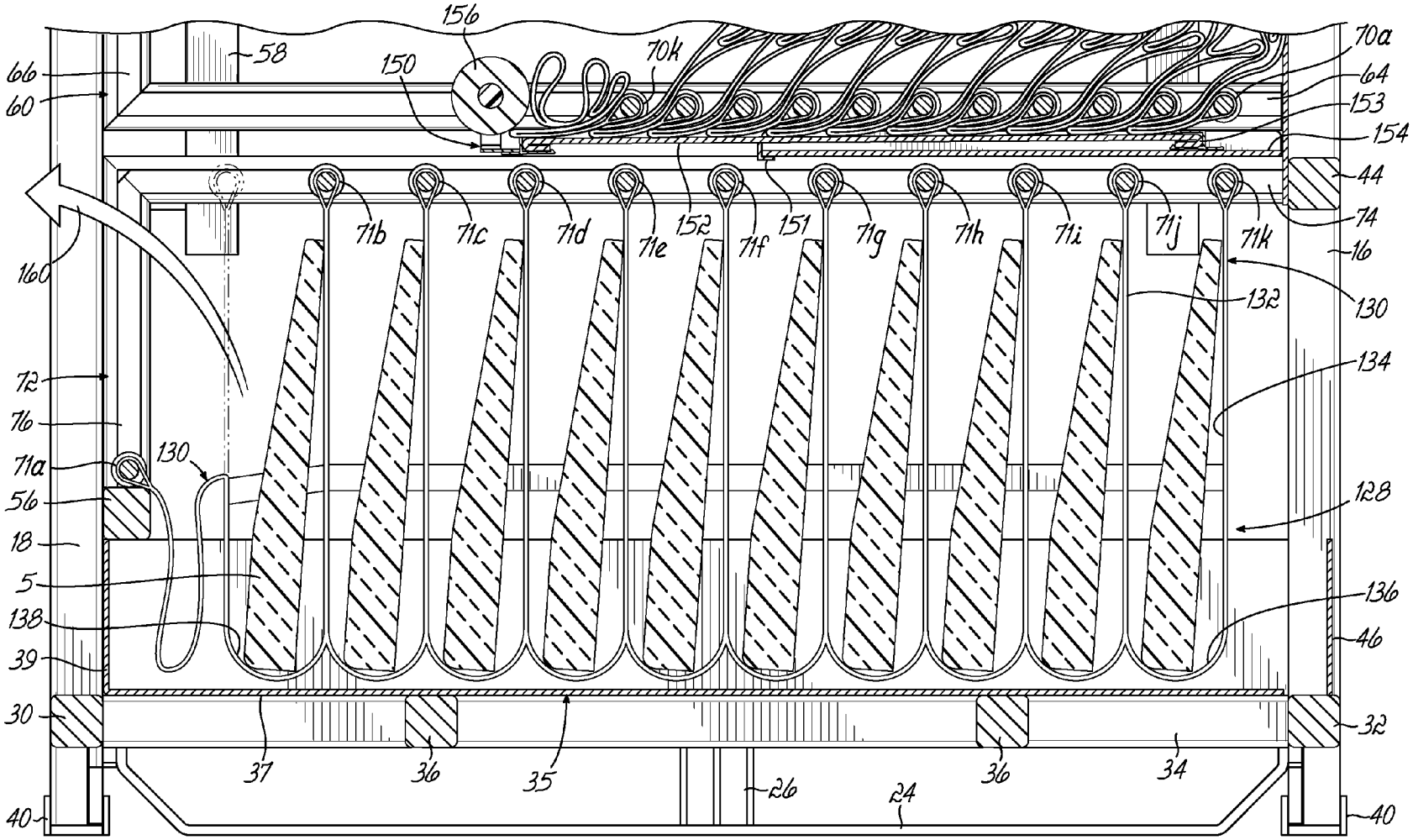
FIG. 3F is a cross-sectional view of a portion of the container of FIG. 1, showing the front product of the lower layer of products being removed.
Figure 3G:
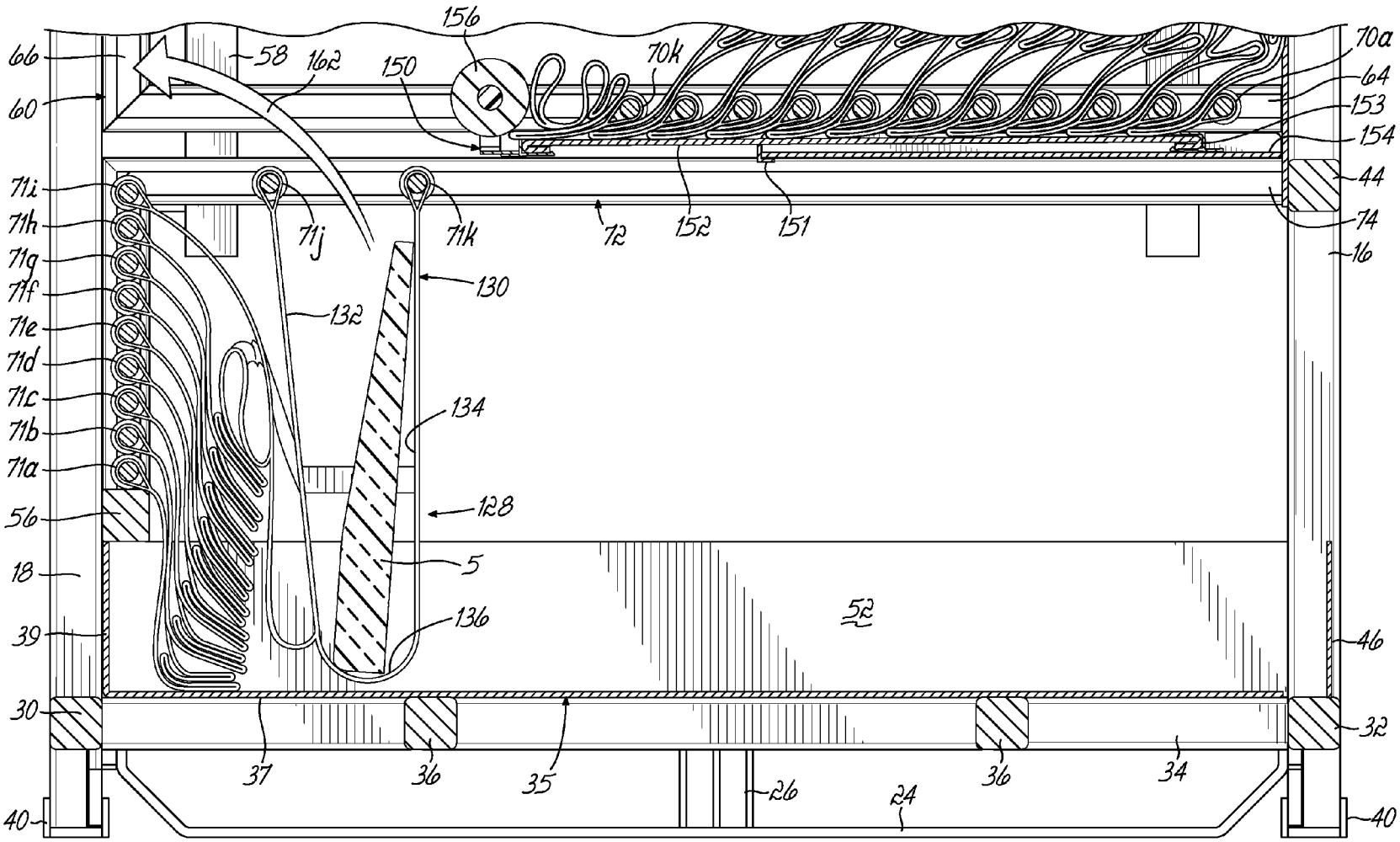
FIG. 3G is a cross-sectional view of a portion of the container of FIG. 1, showing the rear product of the lower layer of products being removed.

As shown in FIG. 3F, the next step comprises removing the front product 5 (closest to the front of the container) out of the dunnage pouch 130 in the lower or bottom level of dunnage 126*b* in the direction of arrow 160. As shown in FIG. 3G, removing product from the lower level of dunnage occurs one product at a time until the last product 5 is removed from the rear pouch 130 of the bottom or lower level of dunnage 126*b* in the direction of arrow 162. When all of the products 5 of lower level 126*b* are removed, the container may be shipped to its desired destination. In the event the container has more than two levels, this process of removing products is repeated one layer or level at a time, each time all the products 5 are removed from the pouches 130 of a level, and each of the dunnage supports are pushed rearwardly to a rear portion of the container, creating open space for the operator to remove products from the next lowest level.

When the container 10 is empty, the empty container 10 still has the dunnage therein. The container 10 may then be shipped back to its original location or any desired location for loading the empty dunnage with product. During the unloading and loading processes, the upper and lower tracks 60, 72, respectively, remain stationary fixedly secured to the container 10. The dunnage supports 70*a*-70*k* and 71*a*-71*k* and dunnage hanging from the dunnage supports move inside the container with the assistance of an operator during the loading and unloading processes.

Figure 4A:
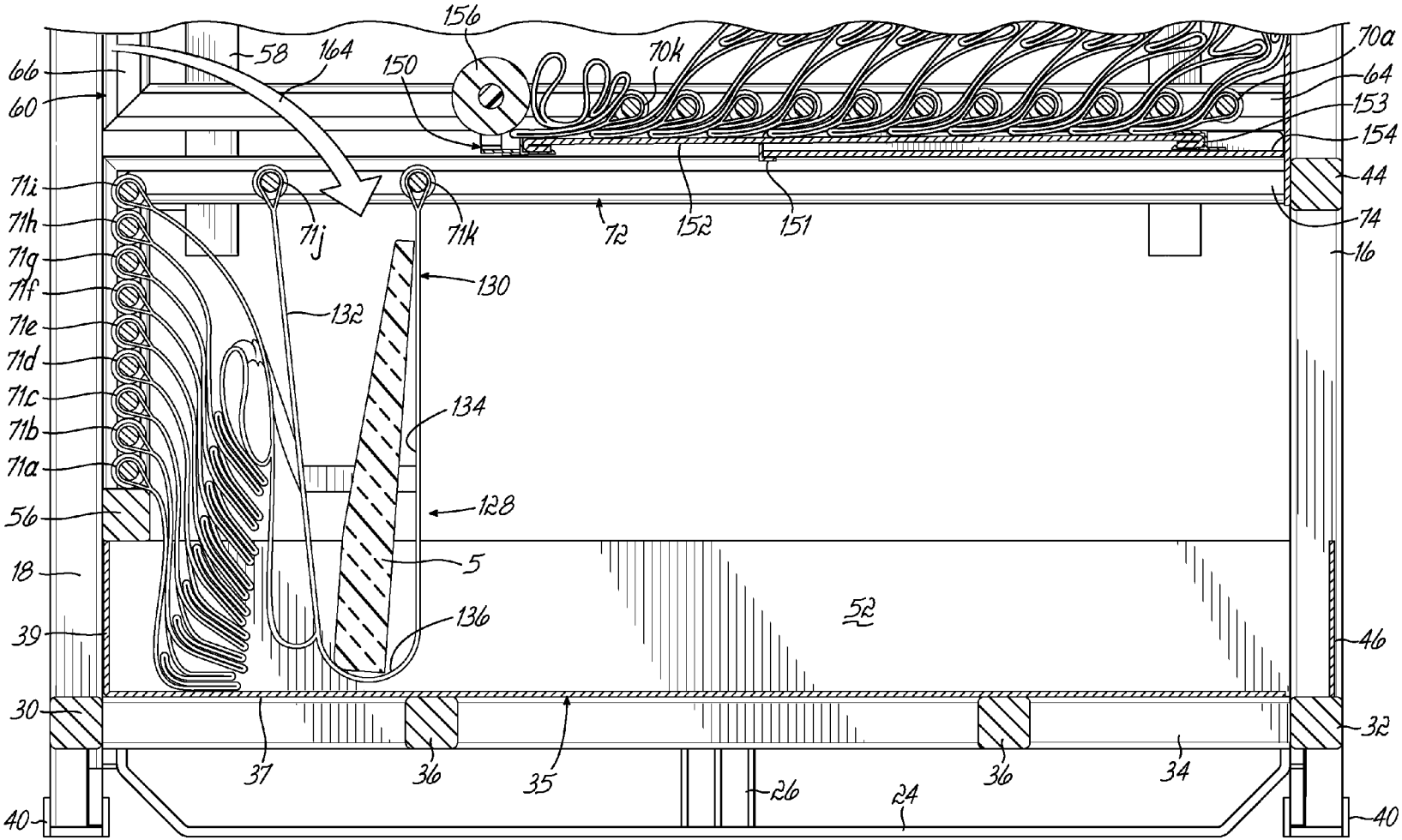
FIG. 4A is a cross-sectional view of a portion of the container of FIG. 1, showing a product being inserted into a rear pouch of the lower layer of dunnage.

FIGS. 4A-4F illustrate a method of loading product 5 into the pouches 130 of emptied container 10. As shown in FIG. 4A, the first step of the loading process comprises loading a product 5 into rear pouch 130 (furthest away from the front of the container) of the bottom level of dunnage 126*b* in the direction of arrow 164.

Figure 4B:
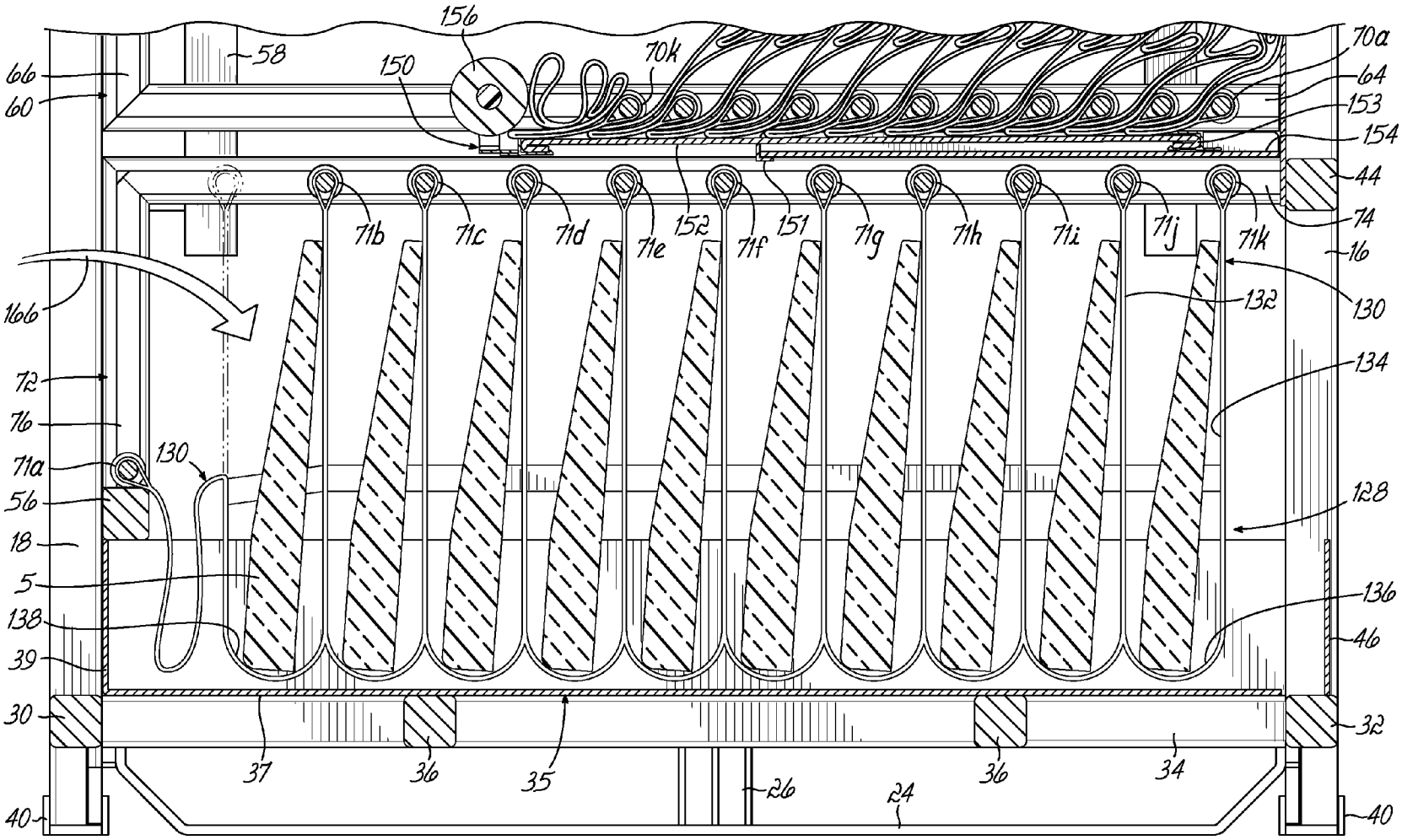
FIG. 4B is a cross-sectional view of a portion of the container of FIG. 1, showing a product being inserted into a front pouch of the lower layer of dunnage.

As shown in FIG. 4B, the next step comprises moving dunnage supports 71*j* and 71*k* supporting the loaded pouch 130 of the bottom level of dunnage 126*b* towards the rear of the container, the end members 90 of dunnage supports 71*j* and 71*k* moving along the generally horizontally oriented portions 74 of the generally L-shaped tracks 72, the loaded rear pouch 130 containing a product 5. The process of loading one pouch at a time of the bottom level of dunnage 126*b* continues until each pouch 130 of the bottom level 126*b* is full. FIG. 4B illustrates an operator (not shown) loading a product 5 into front pouch 130 (closest to the front of the container) of the bottom level of dunnage 126*b* in the direction of arrow 166.

Figure 4C:
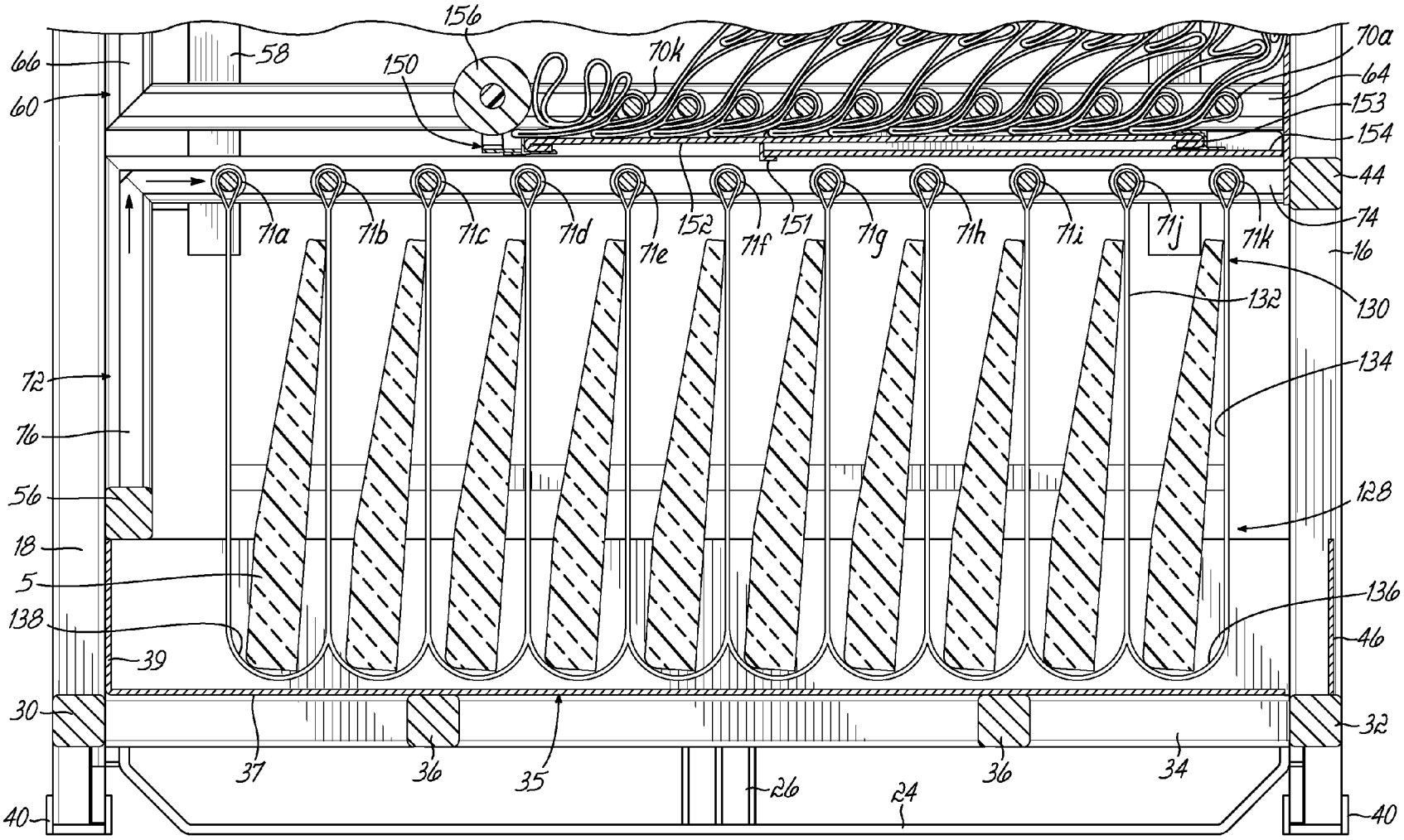
FIG. 4C is a cross-sectional view of a portion of the container of FIG. 1, showing the lower layer of dunnage fully loaded.

As shown in FIG. 4C, after the last product 5 has been inserted into the front pouch 130 of the bottom level of dunnage 126*b* supported by dunnage supports 71*a*, 71*b*, the front dunnage support 71*a* is moved from a position extending between the second portions 76 of the generally L-shaped tracks 72 to a position extending between the first portions 74 of the generally L-shaped tracks 72.

Figure 4D:
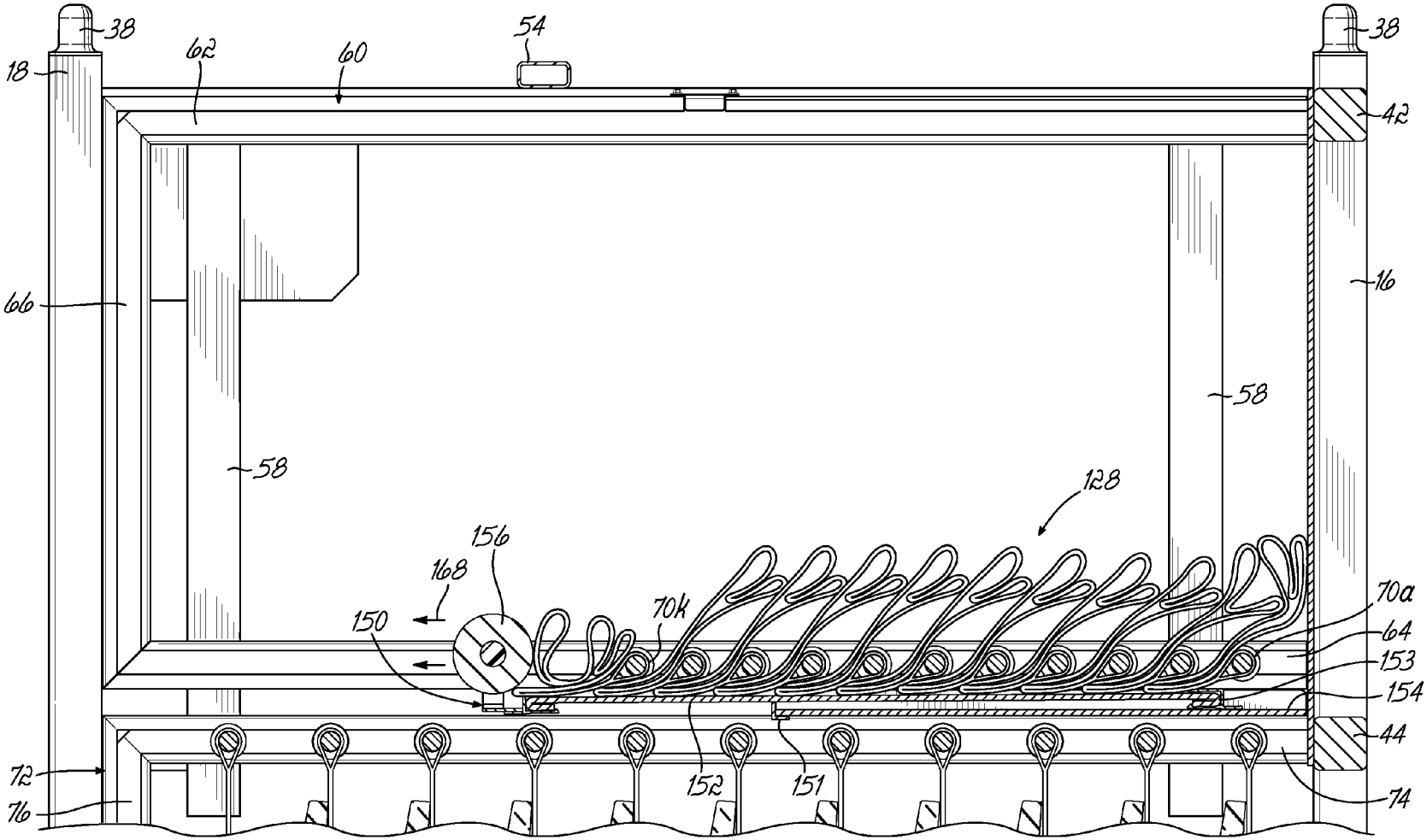
FIG. 4D is a cross-sectional view of a portion of the container of FIG. 1, showing the upper layer of dunnage being moved forwardly on the movable shelf assembly.

As shown in FIG. 4D, after the bottom level 126*b* of dunnage is full, the operator pulls the bumpers forwardly in the direction of arrows 168, thereby moving the front portion of shelf assembly with the empty pouches 130 thereon forwardly. The empty pouches 130 of the upper level 126*a* of dunnage move with the front piece 152 of shelf assembly 150 towards the front of the container in the direction of arrows 168, the upper dunnage supports 70*a*-70*k* moving forwardly along the lower portions 64 of the generally U-shaped tracks 60.

Figure 4E:
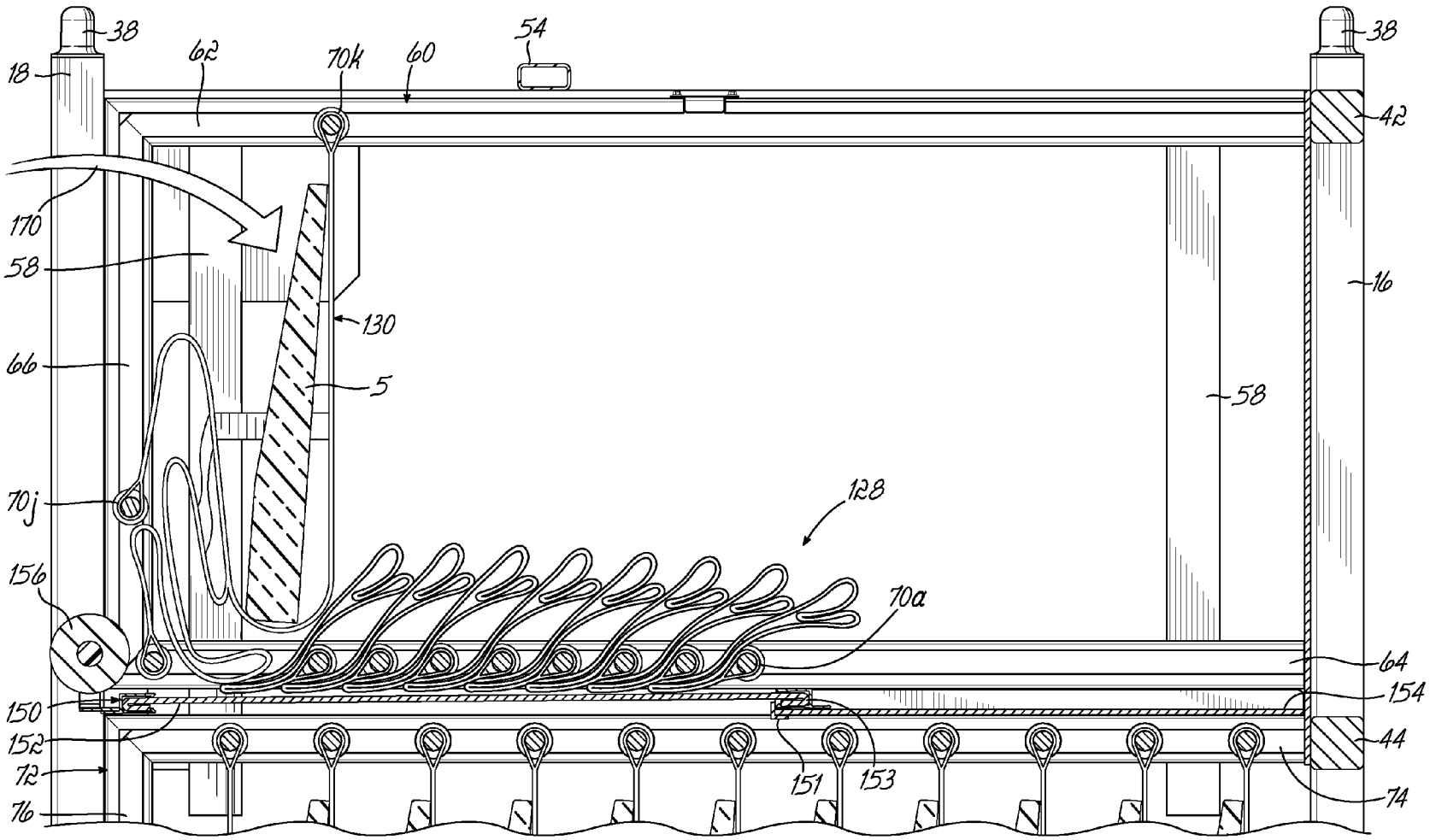
FIG. 4E is a cross-sectional view of a portion of the container of FIG. 1, showing a product being inserted into a rear pouch of the upper layer of dunnage.

As shown in FIG. 4E, the next step comprises inserting another product 5 into the rear pouch 130 of the upper level of dunnage 126*a* in the direction of arrow 170. As shown in FIG. 4E, when the dunnage support 70*k* is in a position extending between the upper portions 62 of generally U-shaped tracks 60, and the dunnage support 70*j* is in a position extending between the connecting portions 66 of generally U-shaped tracks 60, the first product 5 is inserted into the back or rear pouch 130 of the upper layer or level 126*a* of pouches 130.

The next step comprises raising dunnage support 70*j* to a position extending between the upper portions 62 of generally U-shaped tracks 60. Once the dunnage supports 70*k* and 70*j* are in their positions illustrated in FIG. 4F, the operator (not shown) inserts another product 5 into the next pouch 130 of the upper level of dunnage 126*a*. This loading process may be repeated for each pouch 130 of the upper level of dunnage 126*a*. Each time a product 5 is inserted into a dunnage pouch 130 of the upper level of dunnage 126*a*, the dunnage supports 70*a*-70*k* are moved rearwardly with the pouches 130 containing product 5, the end members 90 at the ends of the upper dunnage supports moving along the generally U-shaped tracks 60.

Figure 4F:
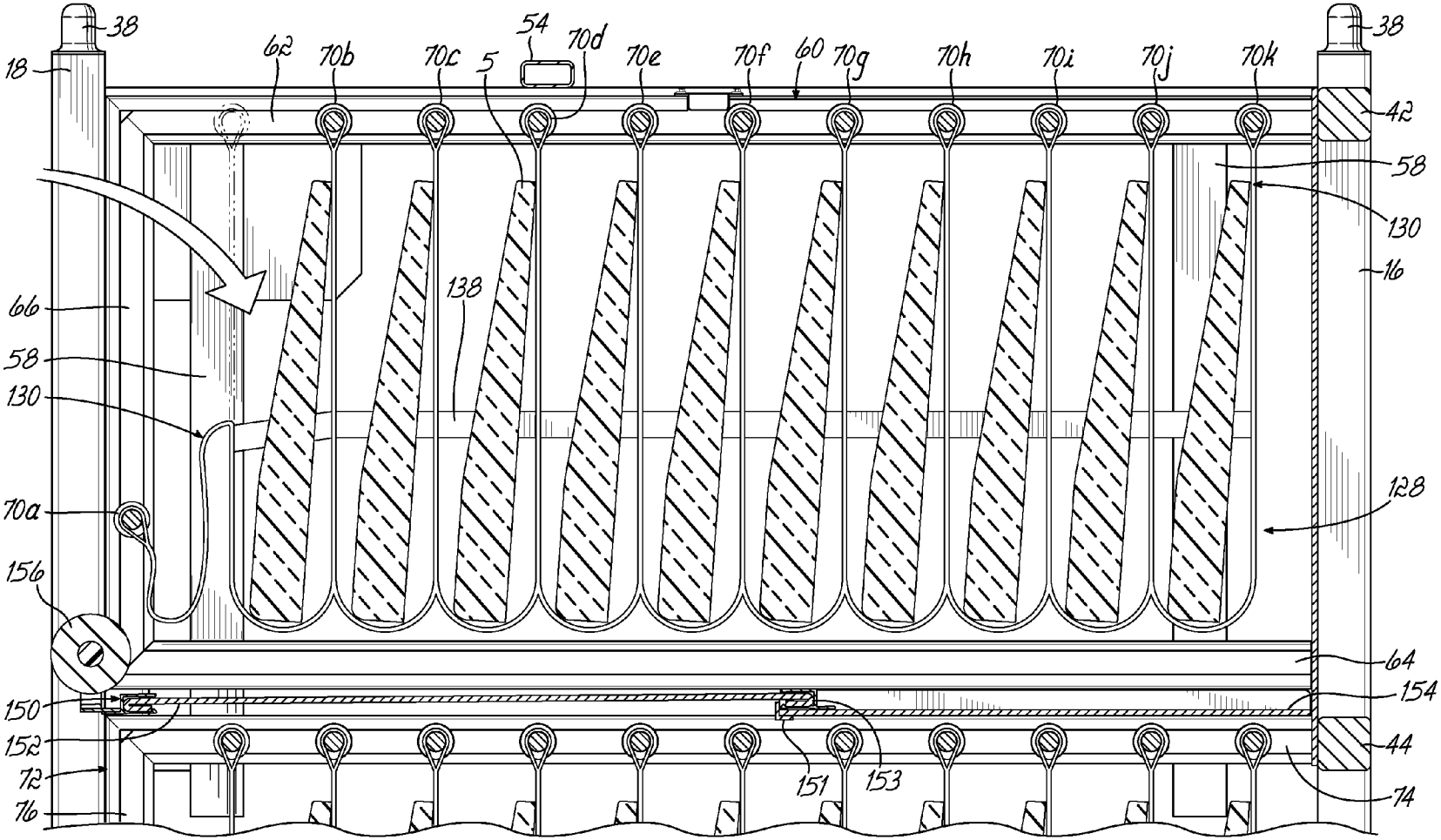
FIG. 4F is a cross-sectional view of a portion of the container of FIG. 1, showing a front product being inserted into a front pouch of the upper layer of dunnage.

As shown in FIG. 4E, when dunnage support 70*j* is located extending between the connecting portions 66 of the generally U-shaped tracks 60, and dunnage support 70*k* is located extending between the upper portions 62 of the generally U-shaped tracks 60, an operator may easily insert a product 5 inside the rear pouch 130 because the dunnage support 70*j* is below dunnage support 70*k*. As shown in FIG. 4F, this is also true when dunnage support 70*a* is below dunnage support 70*b* when an operator is loading a product 5 into the front pouch of the upper layer of dunnage. This orientation of the dunnage supports, due to the configuration of the U-shaped tracks 60, helps an operator from an ergonomic standpoint, reducing the stress and strain on the body of the operator when loading product into the upper layer or level 126*a* of dunnage 128. Thus, the unique configuration of the upper generally U-shaped tracks 60 inside the container 10 may reduce the container owner's costs because workers or operators may have fewer injuries/days off due to injury.

Figure 4G:
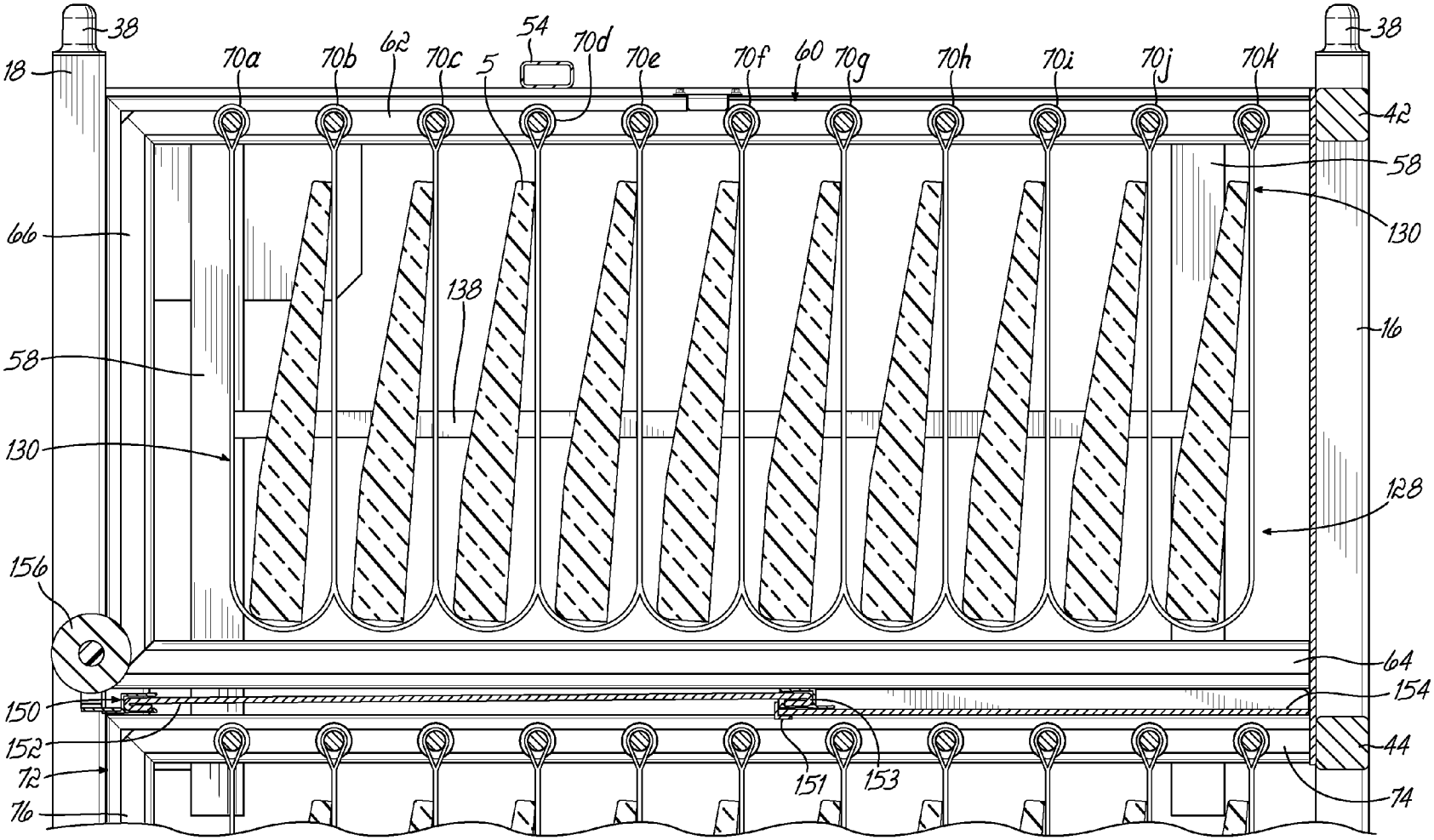
FIG. 4G is a cross-sectional view of a portion of the container of FIG. 1, showing each of the pouches of the upper layer of dunnage containing a product.

As shown in FIG. 4G, once all of the pouches 130 of the upper level of dunnage 126*a* have been loaded with product 5, and the dunnage supports 70*a*-70*k* extend between the upper portions 72 of generally U-shaped tracks 60, the full container may be shipped to its desired destination. In the event the container has more than two levels or layers, the process of loading product 5 is continued by an operator one level at a time, moving upwardly until the container is full of product 5.

Although one specific shape of product 5 is illustrated in the drawings, this document is not intended to limit in any way the size, shape or configuration of product 5 shipped or stored in any of the embodiments described or shown herein.

Figure 5:
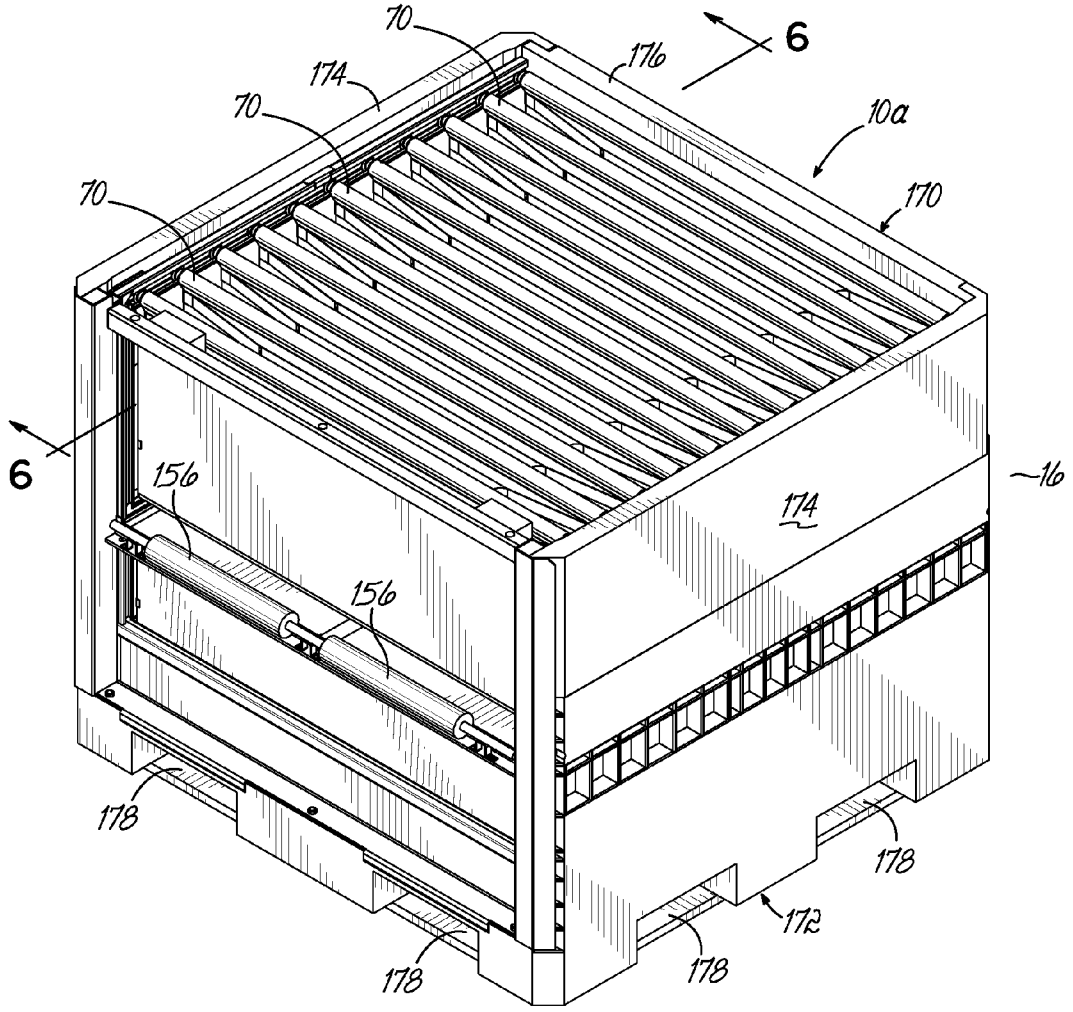
FIG. 5 is a perspective view of another embodiment of a reusable and returnable container.
Figure 6:
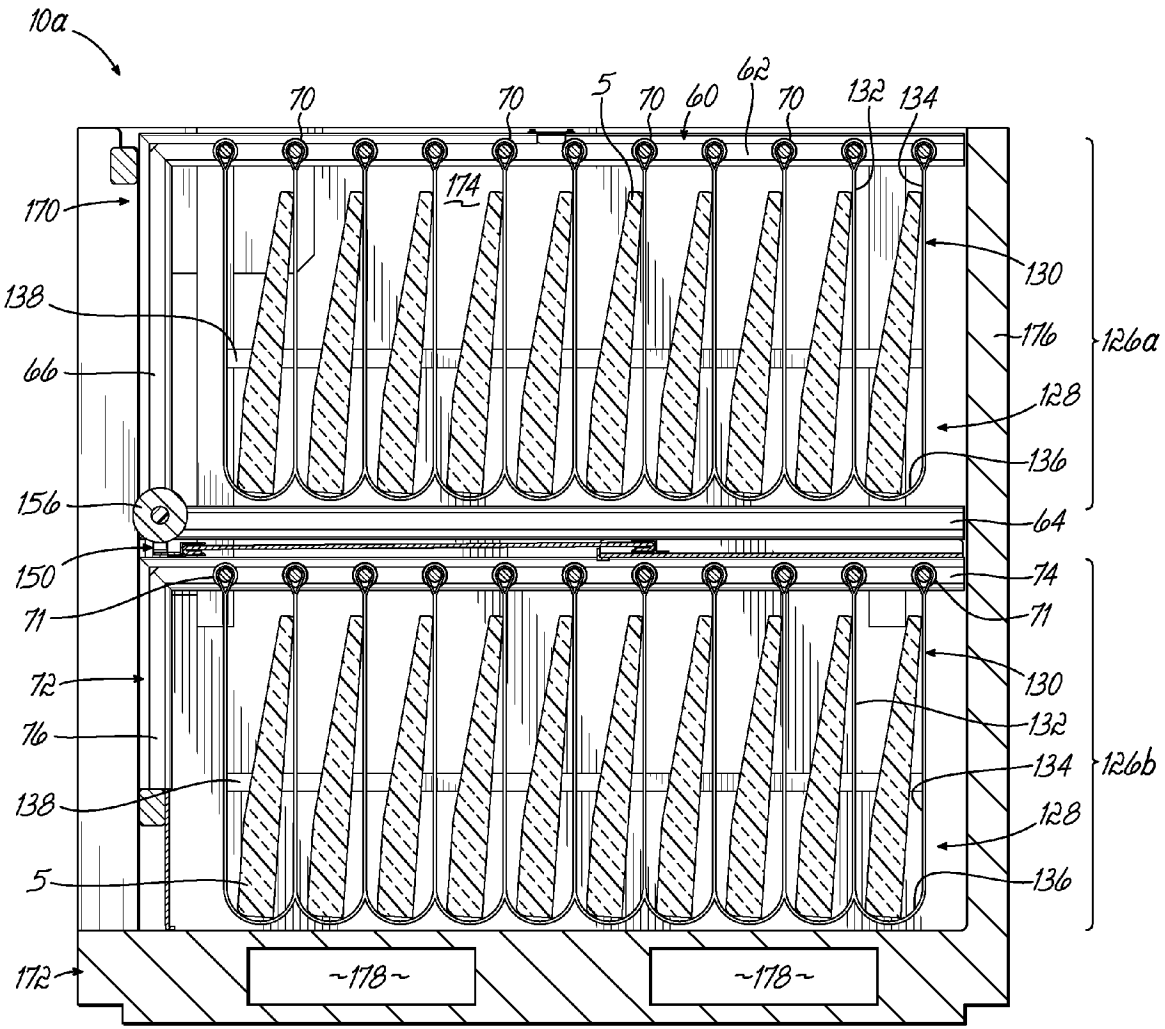
FIG. 6 is a cross-sectional view of one side of the container of FIG. 5 loaded with products.

FIGS. 5 and 6 illustrate an alternative embodiment of container 10*a*. Container 10*a* is identical to container 10, except for the outside of the container. The reusable and returnable container 10*a*, as shown, comprises a body 170 having a base 172, opposed sides 174 and a rear 176, all extending upwardly from the base 172. The sides 174 and rear 176 may be hingedly secured to the base 172. The base 172 may have a plurality of passages 178 therethrough adapted to receive the prongs of a forklift for purposes of lifting and moving the container 10*a*. Although one configuration of body in the form of a pallet box is illustrated, the present invention may be used with other types or configurations of container bodies.

All the remaining components of container 10*a* are identical to those of container 10 shown in FIGS. 1-4G. For the sake of simplicity, like parts have like numbers.

Figure 7:
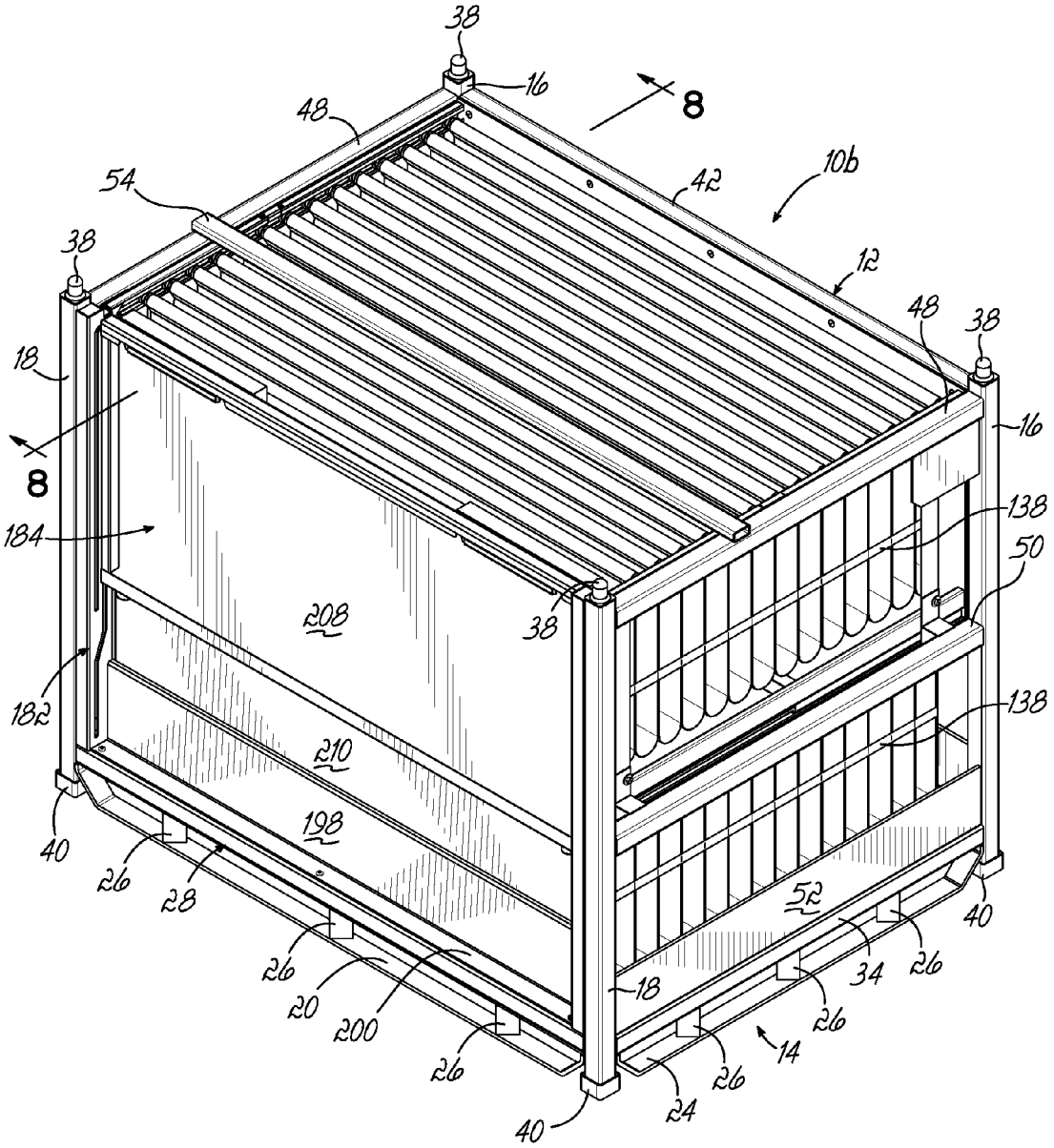
FIG. 7 is a perspective view of another embodiment of a reusable and returnable container.
Figure 8:
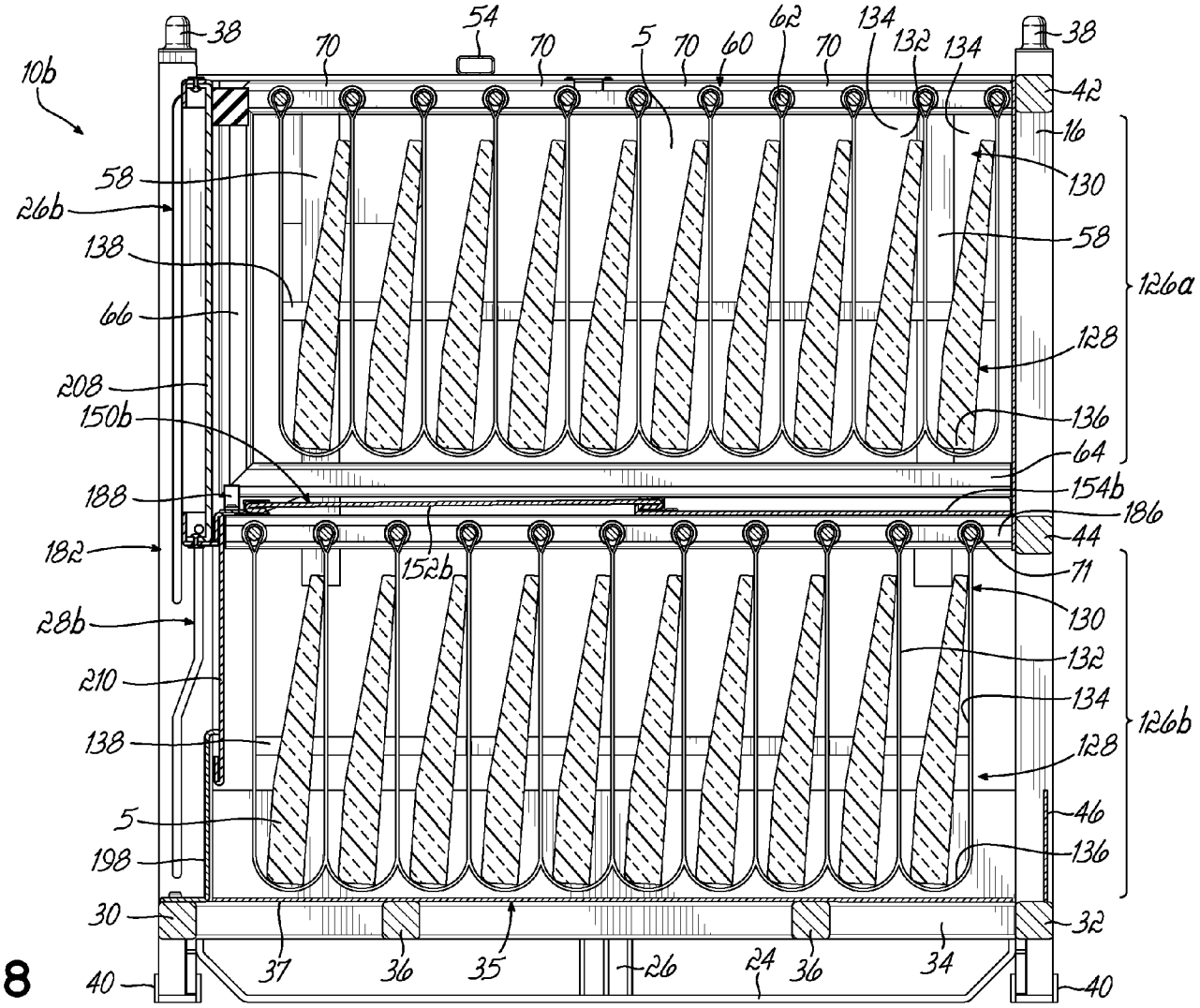
FIG. 8 is a cross-sectional view of one side of the container of FIG. 7 loaded with products.

FIGS. 7 and 8 illustrate an alternative embodiment of container 10*b*. Container 10*b* is similar to container 10, but has different lower tracks and a different shelf assembly than container 10. In addition, container 10*b* has a door guide assembly 182 and movable door assembly 184, like those disclosed in U.S. Pat. No. 9,010,563, which is fully incorporated herein. For the sake of simplicity, like parts have like numbers.

Figure 7A:
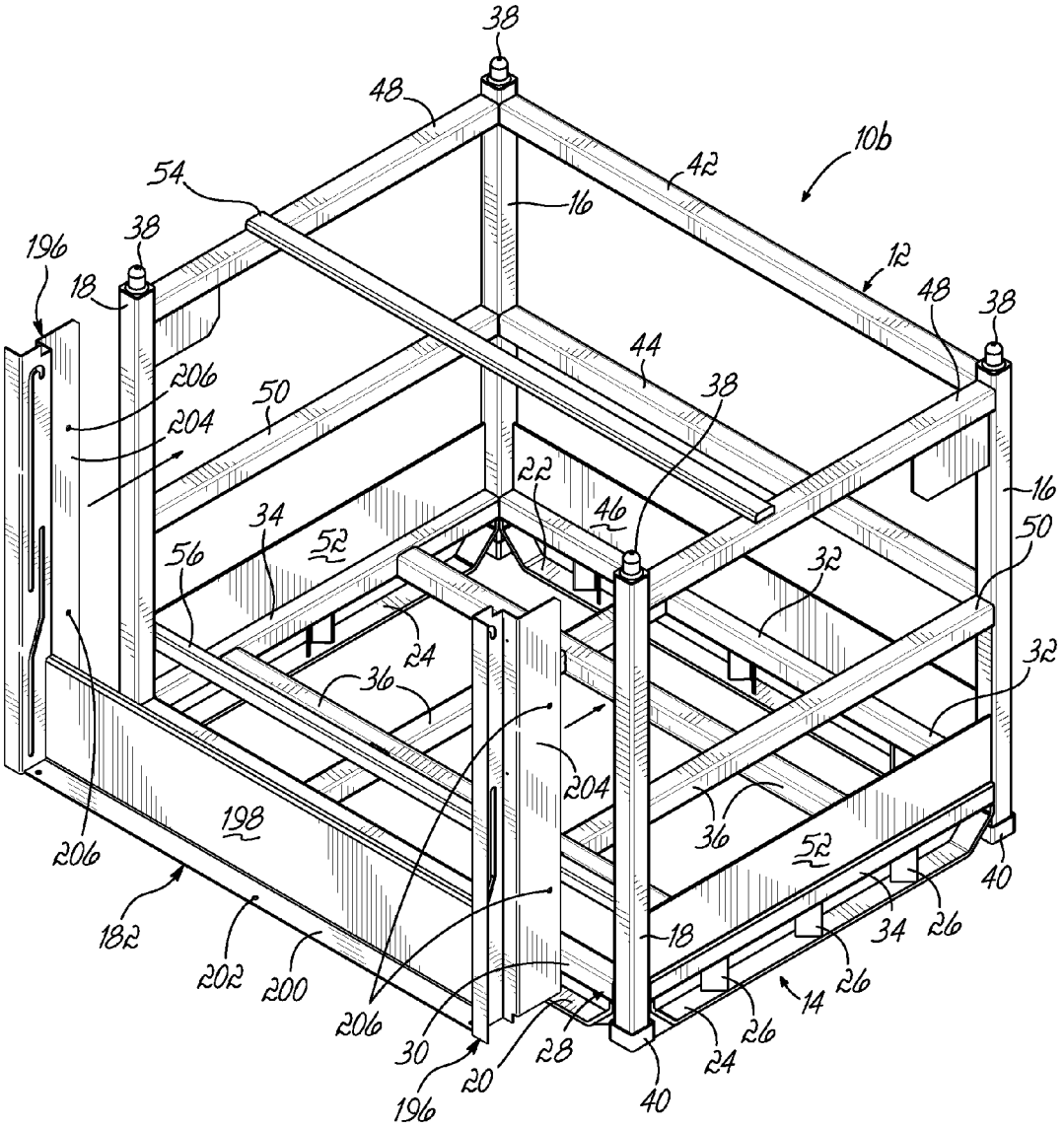
FIG. 7A is a perspective view of a portion of the metal frame and door guide assembly of the container of FIG. 7.
Figure 7B:
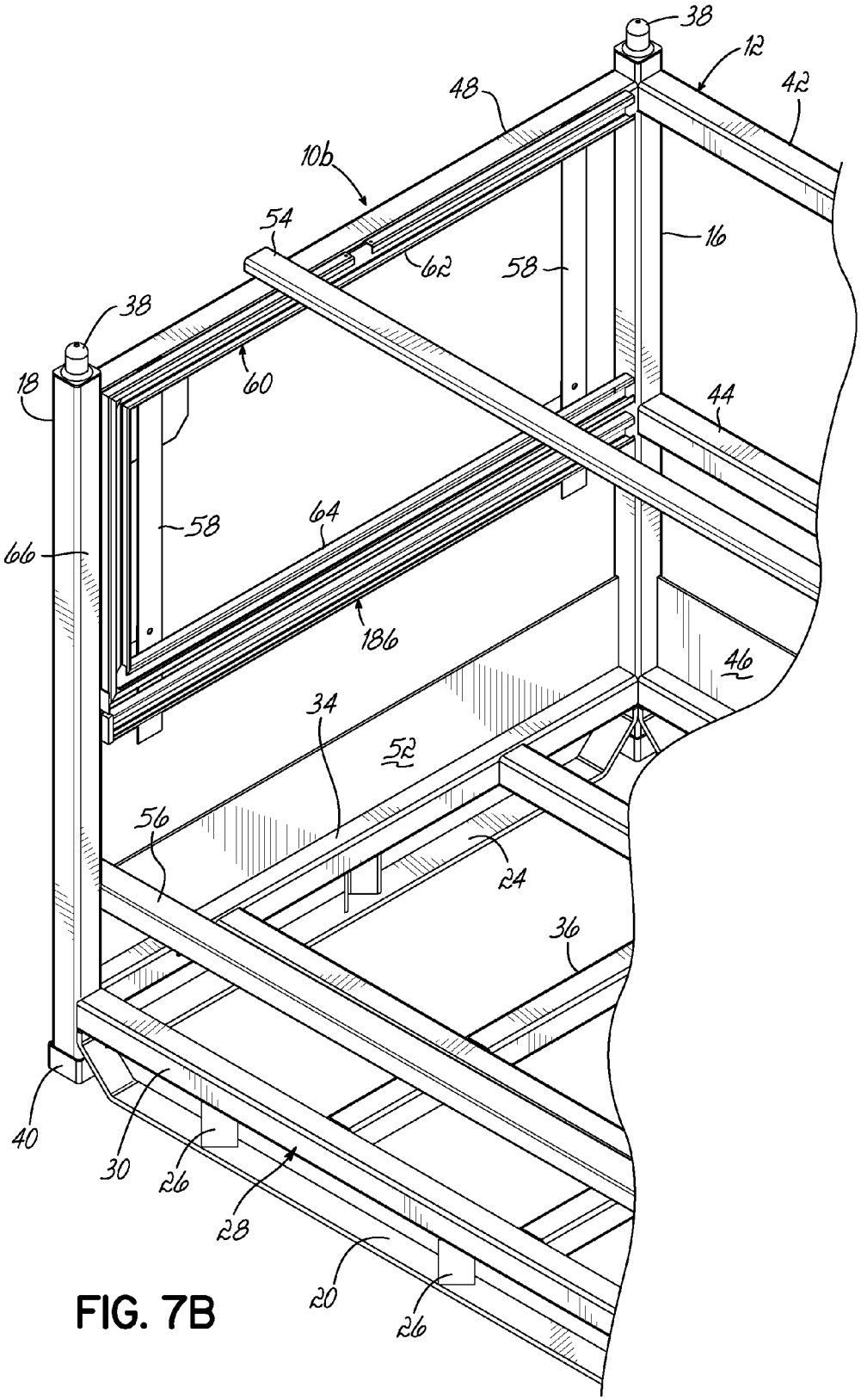
FIG. 7B is a perspective view of a portion of the metal frame and the tracks on one side of the container of FIG. 7.

As best shown in FIG. 7B, container 10*b* comprises a stationary straight lower track 186 secured to the track supports 58 on each side of the container 10*b*, in place of the stationary generally L-shaped lower track 72 of container 10. FIG. 7B illustrates one side of container 10*b*; the same tracks are located on the opposite side of container 10*b* (not shown).

Figure 7C:
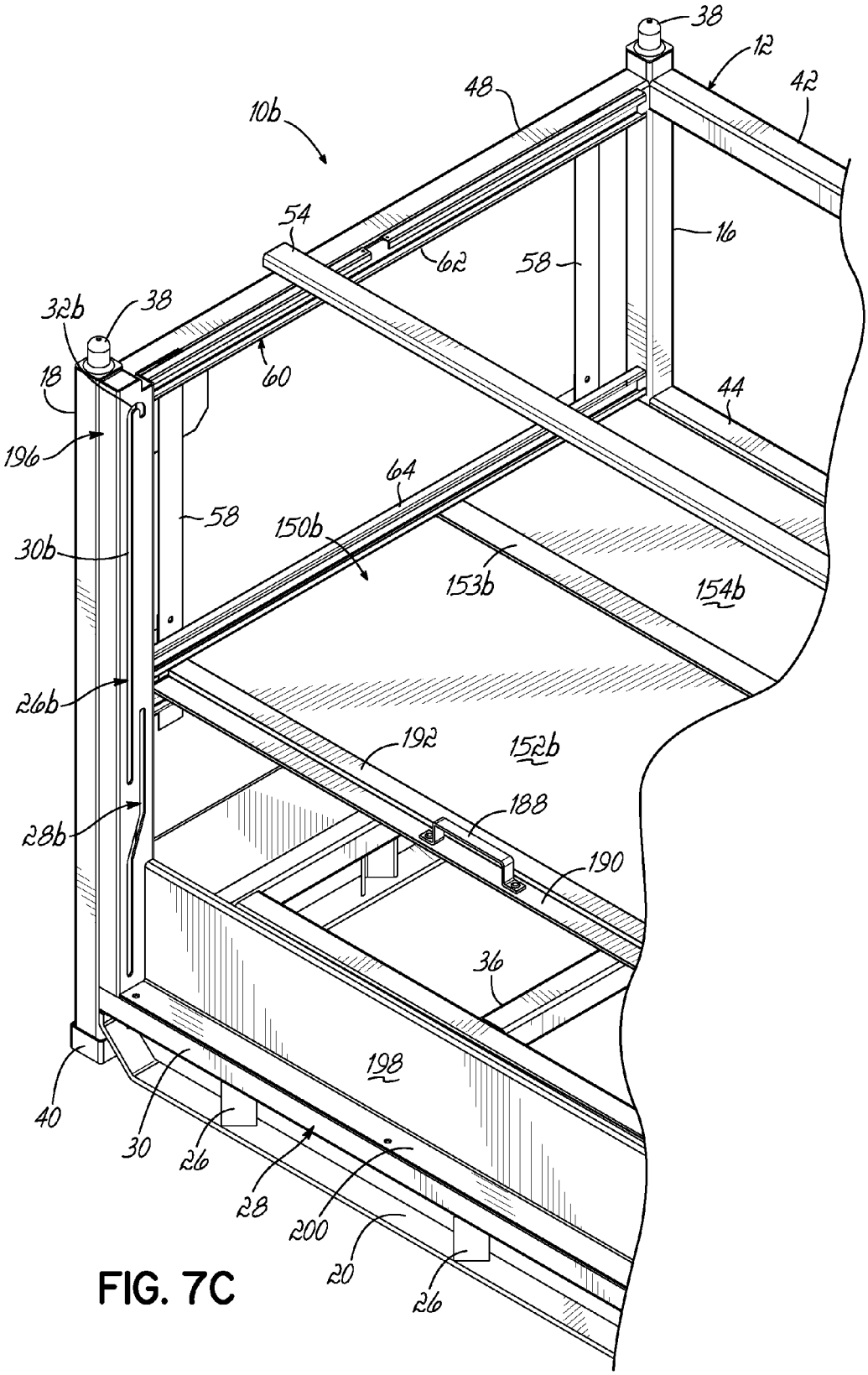
FIG. 7C is a perspective view of a portion of the metal frame and a portion of the shelf assembly of the container of FIG. 7.

As shown in FIGS. 7C and 8, the shelf assembly 150*b* of container 10*b* comprises a movable front piece or component 152*b* and a stationary rear piece or component 154*b*. As shown in FIG. 7C, a flange 190 is attached to a front bracket 192 of the front piece 152*b* of shelf assembly 150*b*. A handle 188 is attached to the flange 190. Although one handle 188 having a generally U-shaped configuration is illustrated, any number of handles of any desired shape or size may be part of the movable portion of the shelf assembly. The handle or handles may be used by a person to move the front piece of shelf assembly to create an opening in front of the rear piece of the shelf assembly for insertion of products into dunnage of the lower level or insertion of products into the lower level of dunnage. Alternatively, the front piece of the shelf assembly may lack any handle and be moved without the use of a handle.

Figure 8A:
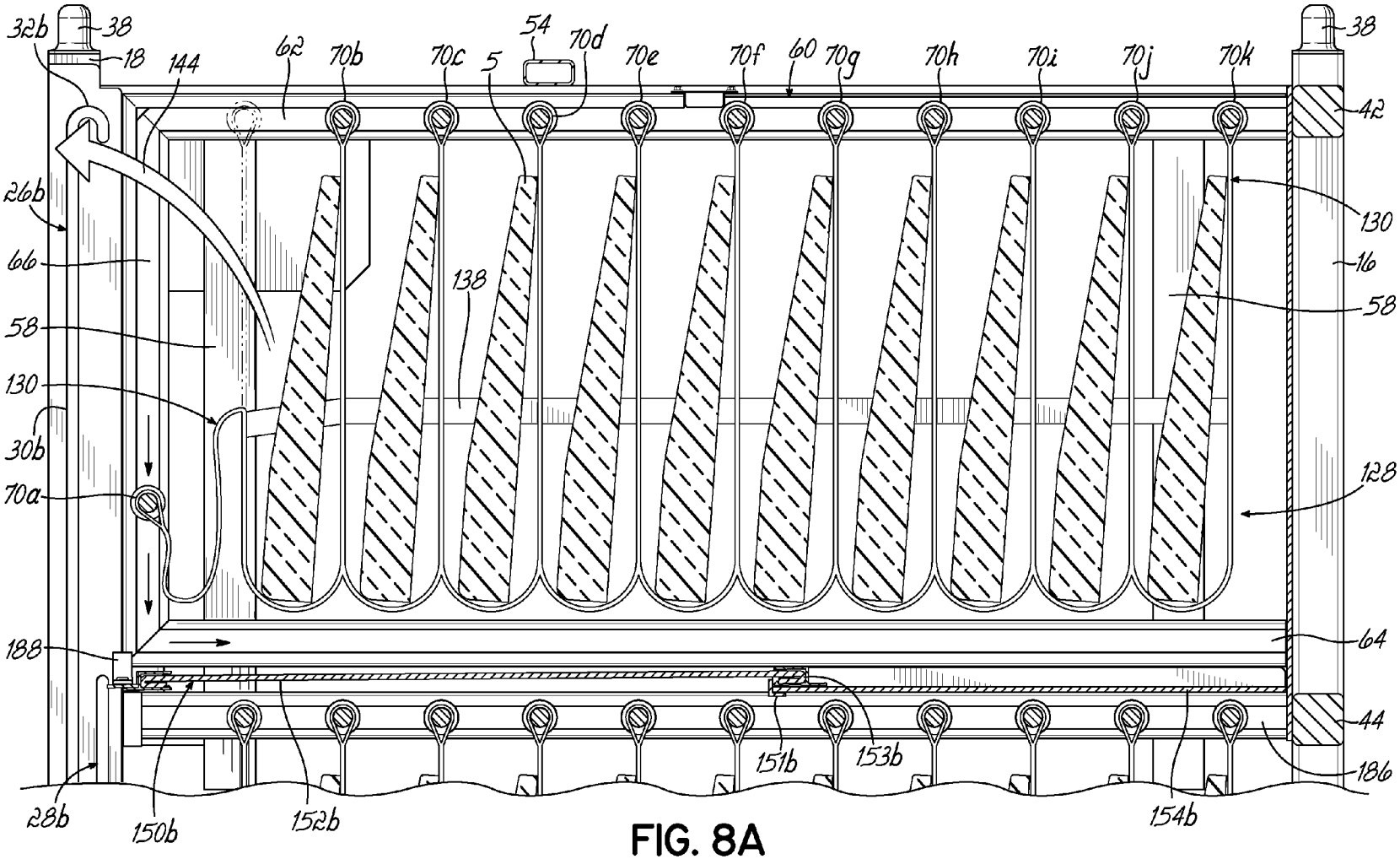
FIG. 8A is a cross-sectional view of a portion of the container of FIG. 7, showing the front product of an upper layer of products being removed.

As shown in FIG. 8A, the rear piece 154*b* of the shelf assembly 150*b* has a stop 151*b* along the front edge thereof which abuts a front edge of curved portion or flange 153*b* along the rear edge of the front piece 152*b* to limit forward movement of the front piece 152*b* of shelf assembly 150*b*. Although one configuration of stop 151*b* and one configuration of flange 153*b* are illustrated, other configurations may be used to limit forward movement of the front piece 152*b* of shelf assembly 150*b*. FIG. 8A shows the shelf assembly 150*b* between the lower portions 64 of generally U-shaped tracks 60 and the straight lower tracks 186.

Referring to FIG. 7A, container 10*b* further comprises a metal generally U-shaped door guide assembly 182 comprising two opposed door guides 196 and a panel 198 extending between the door guides 196 and welded thereto. The panel 198 has a bottom flange 200 which may be secured to the perimeter member 30 of the sub-base 28 of the rack 12 using welding or fasteners or any other known technique. For example, the bottom flange 200 of the panel 198 is illustrated having holes 202 through which fasteners may pass. Each door guide 196 has a flange 204 which has holes 206 therethrough so the door guide 196 may be secured via bolts or any other conventional manner to the rack 12.

Each of the metal guides 196 has two slots therethrough, an upper slot 26*b* and a lower slot 28*b* as shown and described in U.S. Pat. No. 9,010,563. However, any number of slots of any desired shape may be incorporated into the metal guides 196. As best shown in FIG. 7C, upper slot 26*b* has a "candy cane" shape comprising a straight portion 30*b* and a curved upper portion 32*b*. The lower slot 28*b* is not linear, but rather has a "Z" shape. These upper and lower slots 26*b*, 28*b* are used to secure a movable multi-segmented or multi-piece door assembly 184 having movable door segments 208, 210 which operate as described in U.S. Pat. No. 9,010,563. These slots 26*b*, 28*b* guide the movable door segments 208, 210 of door assembly 182 during its movement from an upper or raised position and a lower or dropped position. If desired, the metal guides 196 may have slots of other configurations shown and described in U.S. Pat. No. 9,010,563 adapted to guide any other door panel or assembly disclosed in U.S. Pat. No. 9,010,563. For example, the door assembly may have only one movable panel, as opposed to two movable panels or pieces.

Figure 9:
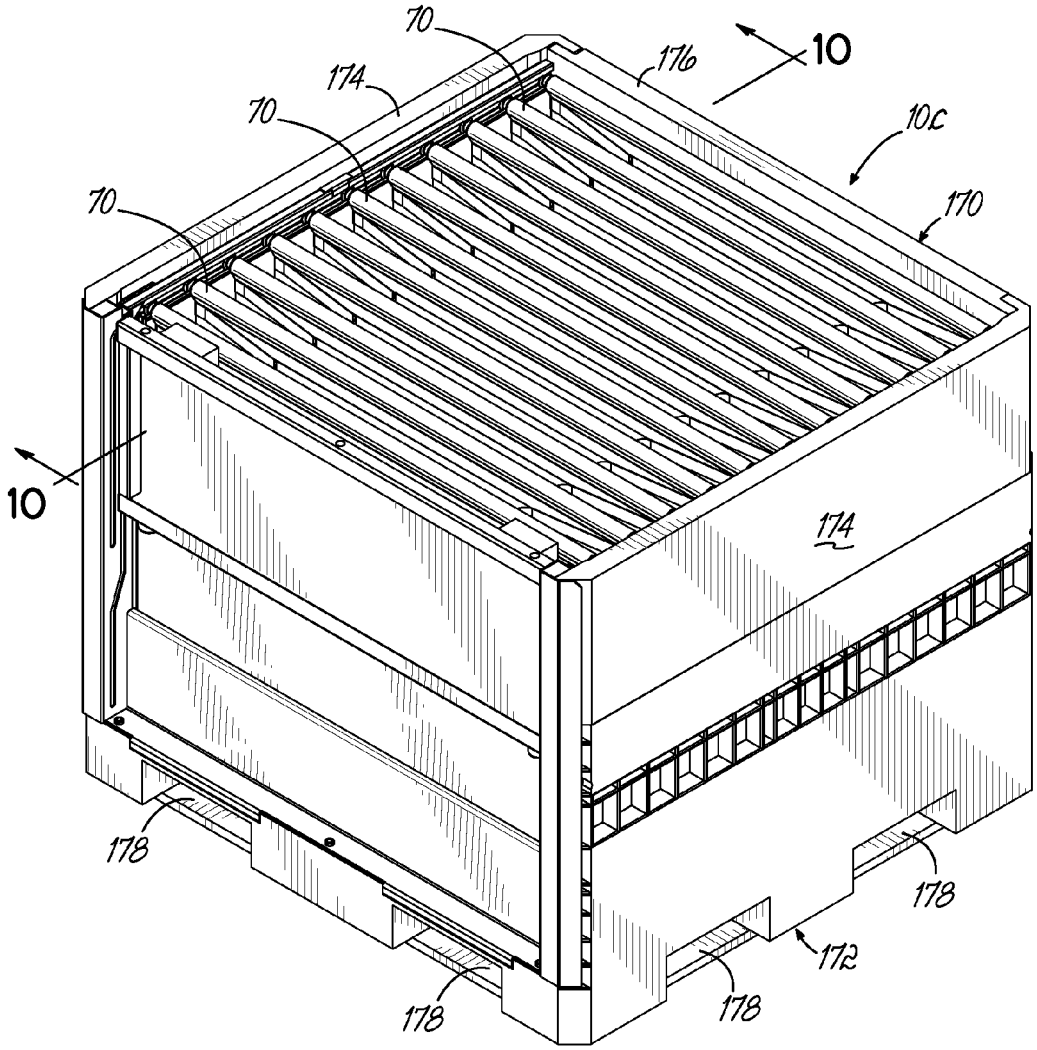
FIG. 9 is a perspective view of another embodiment of a reusable and returnable container.
Figure 10:
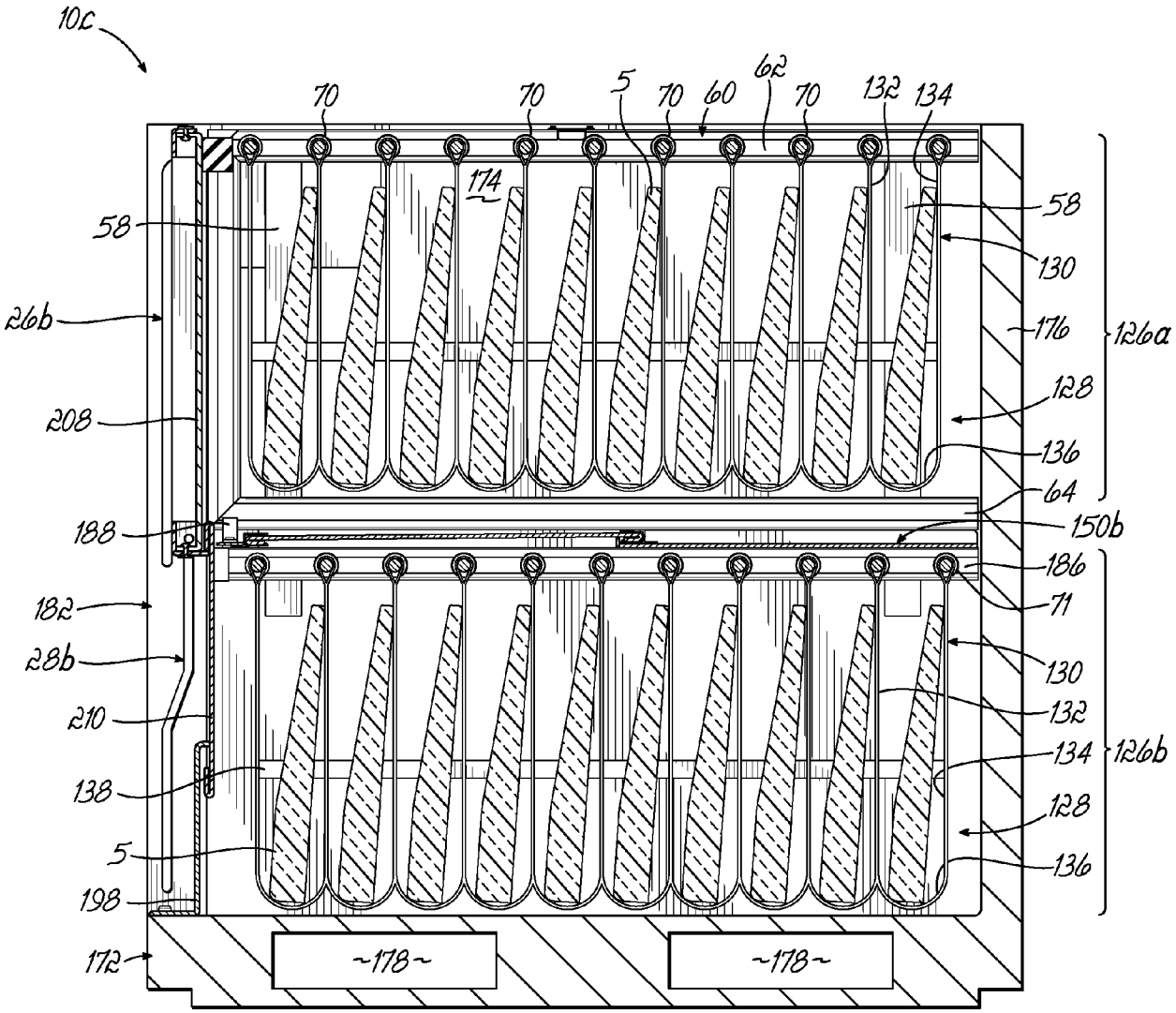
FIG. 10 is a cross-sectional view of one side of the container of FIG. 9 loaded with products.

FIGS. 9 and 10 illustrate an alternative embodiment of container 10*c*. Container 10*c* is similar to container 10*a*, but has different lower tracks and a different shelf assembly than container 10*a*. In addition, container 10*c* has a door guide assembly 182 and movable door assembly 184, as described above with regards to container 10*b*. For the sake of simplicity, like parts have like numbers.

As shown in FIG. 10, the reusable and returnable container 10*c*, as shown, comprises a stationary straight lower track 186 secured to the track supports 58 on each side of the container 10*c*, in place of the stationary generally L-shaped lower track 72 of container 10*a* shown in FIGS. 5-6. As shown in FIG. 10, container 10*c* has the same shelf assembly 150*b* as container 10*b* described above.

While various embodiments of the present invention have been illustrated and described in considerable detail, it is not the intention of the applicant to restrict or in any way limit the scope of the claims to such detail. Additional advantages and modifications will readily appear to those skilled in the art. The invention in its broader aspect is, therefore, not limited to the specific details, representative system, apparatus, and method, and illustrative example shown and described. Accordingly, departures may be made from such details without departing from the spirit or scope of the applicant's general inventive concept.

What is claimed is:

1. A container for holding product therein during shipment, the container comprising:

a base and two opposed sides;

a generally U-shaped track supported by each side of the container, said generally U-shaped track having an upper portion extending from front to back inside the container proximate an upper edge of the container and a lower portion extending from front to back inside the container spaced apart from the upper portion, said upper and lower portions being joined by a connecting portion;

a shelf assembly comprising at least one piece movable to create an opening to allow movement of products through the opening;

movable dunnage supports extending between tracks on said opposed sides of the container; and dunnage supported by the dunnage supports.

2. The container of claim 1 wherein the dunnage comprises pouches.

3. The container of claim 1 wherein the shelf assembly is adapted to support and move emptied dunnage.

4. The container of claim 1 further comprising a track below the shelf assembly supported by each side of the container.

5. The container of claim 1 further comprising a movable door assembly.

6. The container of claim 1 further comprising a plurality of track supports secured to the sides of the container, the tracks being secured to the track supports.

7. The container of claim 5 further comprising a door guide assembly having two sides, each side having multiple slots, portions of the movable door assembly having pins movable in the slots.

8. The container of claim 7 wherein each side of the door guide assembly has two slots.

9. The container of claim 1, at least some of the dunnage supports comprising end members movable along the tracks and a middle member extending between the end members.

10. A container for holding product therein during shipment, the container comprising:

a base and opposed sides;

a plurality of tracks supported by each side of the container, one of the tracks on each side having an upper portion extending from front to back inside the container and a lower portion extending from front to back inside the container spaced apart from the upper portion, said upper and lower portions being joined by a linear connecting portion extending between the front of the upper and lower portions inside the container;

a plurality of movable dunnage supports extending between opposed tracks;

a shelf assembly comprising at least one movable component wherein the movable component is moved rearwardly to create an opening to allow access to products below the shelf assembly; and dunnage supported by the dunnage supports.

11. The container of claim 10 wherein the shelf assembly supports empty dunnage and may be moved to a position to allow access to a lower level of dunnage.

12. The container of claim 10 wherein each of the dunnage supports comprises end members movable along corresponding tracks and a middle member extending between the end members.

13. The container of claim 10 wherein each side of the container has two tracks, a generally U-shaped track above the shelf assembly and a generally straight track below the shelf assembly.

14. The container of claim 10 further comprising a door guide assembly having two sides, each side having multiple slots and a movable door assembly having pins movable in the slots.

15. The container of claim 14 wherein each side of the door guide assembly has two slots.

16. The container of claim 14 wherein the door assembly is movable between a raised and locked position and a dropped position.

17. The container of claim 16 wherein the container has an opening above the movable door assembly when the movable door assembly is in its dropped position, thereby allowing movement of products through the opening.

18. A container for holding product therein during shipment, the container comprising:

a base and opposed sides;

first and second tracks supported by each side of the container, each of the first tracks having a first portion extending from front to back inside the container proximate an open top of the container, a second portion extending from front to back inside the container spaced below the first portion and a connecting portion joining the first and second portions;

a plurality of movable dunnage supports extending between the first tracks and being movable along a generally U-shaped path;

dunnage supported by the dunnage supports;

a shelf assembly extending between the opposed sides of the container below the first tracks, the shelf assembly being adapted to receive and move empty dunnage.

19. The container of claim 18 wherein the second tracks are linear.

20. The container of claim 18 wherein at least some of the dunnage supports comprise end members movable along corresponding tracks and a middle member extending between the end members.

* * * * *